US011021953B1

(12) United States Patent
Myers et al.

(10) Patent No.: US 11,021,953 B1
(45) **Date of Patent: *Jun. 1, 2021**

(54) MATERIAL-REMOVAL SYSTEMS, CUTTING TOOLS THEREFOR, AND RELATED METHODS

(71) Applicant: APERGY BMCS ACQUISITION CORPORATION, Orem, UT (US)

(72) Inventors: Russell R. Myers, Salem, UT (US); Grant K. Daniels, Spanish Fork, UT (US); Heath C. Whittier, Orem, UT (US)

(73) Assignee: APERGY BMCS ACQUISITION CORPORATION, Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/527,620

(22) Filed: Jul. 31, 2019

Related U.S. Application Data

(63) Continuation of application No. 14/811,699, filed on Jul. 28, 2015, now Pat. No. 10,408,057.
(Continued)

(51) Int. Cl.
*E21C 35/183* (2006.01)
*E21C 35/19* (2006.01)
*E21C 25/06* (2006.01)

(52) U.S. Cl.
CPC ..... *E21C 35/183* (2013.01); *E21C 25/06* (2013.01); *E21C 35/19* (2013.01);
(Continued)

(58) Field of Classification Search
CPC ..... E21C 27/22; E21C 35/183; E21C 2035/1903; E21C 2035/1806; E21C 2035/1813; E21C 2035/1816; E21C 2035/1803; E21C 2035/1809; E21C 35/19; E21C 25/06; E21D 9/11; E21D 9/104; E21B 10/55; E21B 2010/545
See application file for complete search history.

(56) References Cited

U.S. PATENT DOCUMENTS 2,665,893 A 1/1954 Ball
3,342,532 A 9/1967 Krekeler et al.
(Continued)

FOREIGN PATENT DOCUMENTS

AU 2013101370 A4 11/2013
CN 102108866 A 6/2011
(Continued)

OTHER PUBLICATIONS

Advisory Action for U.S. Appl. No. 14/266,437 dated Mar. 24, 2017.
(Continued)

*Primary Examiner* — Janine M Kreck
*Assistant Examiner* — Michael A Goodwin
(74) *Attorney, Agent, or Firm* — Dorsey & Whitney LLP

(57) ABSTRACT

Embodiments described herein relate to material-removal systems and cutting tools that may be used in the material-removal systems. More specifically, for example, the material-removal systems, and particularly the cutting tools thereof, may engage and fail target material. In some instances, the material-removal systems may be used in mining operations.

27 Claims, 9 Drawing Sheets

Related U.S. Application Data

(60) Provisional application No. 62/030,525, filed on Jul. 29, 2014.

(52) U.S. Cl.
CPC ..... *E21C 35/1831* (2020.05); *E21C 35/1835* (2020.05); *E21C 35/1837* (2020.05)

(56) References Cited

U.S. PATENT DOCUMENTS 3,544,166 A 12/1970 Proctor
3,671,075 A 6/1972 Bland et al.
3,695,726 A 10/1972 Krekeler
3,751,114 A 8/1973 Davis
3,785,021 A 1/1974 Norgren et al.
3,841,708 A 10/1974 Kniff et al.
D238,243 S 12/1975 Polivka
3,958,832 A * 5/1976 Sigott ..... E21D 9/104 299/87.1
4,006,936 A 2/1977 Crabiel
4,083,644 A 4/1978 Friedline et al.
4,140,189 A 2/1979 Garner
4,193,638 A 3/1980 Heckenhauer
4,200,159 A 4/1980 Jurgens et al.
4,299,424 A 11/1981 LeBegue et al.
4,303,136 A 12/1981 Ball
4,335,921 A 6/1982 Swisher et al.
4,337,980 A 7/1982 Krekeler et al.
4,340,325 A 7/1982 Gowanlock et al.
D270,059 S 8/1983 Wilkins
D271,497 S 11/1983 Green
4,484,644 A 11/1984 Cook et al.
4,580,930 A 4/1986 Zinner et al.
4,605,343 A 8/1986 Hibbs, Jr. et al.
4,655,508 A 4/1987 Tomlinson
4,678,237 A 7/1987 Collin
4,679,858 A 7/1987 Tank
D296,107 S 6/1988 Andersson
4,765,687 A 8/1988 Parrott
4,784,023 A 11/1988 Dennis et al.
4,787,466 A 11/1988 Tomlinson et al.
4,836,178 A 6/1989 Tomlinson
4,842,337 A 6/1989 Southern
4,850,649 A 7/1989 Beach et al.
4,880,278 A 11/1989 Tomlinson
4,902,073 A 2/1990 Tomlinson et al.
D307,279 S 4/1990 Vincent
4,913,125 A 4/1990 Bunting et al.
D311,747 S 10/1990 Mihic
5,007,685 A 4/1991 Beach et al.
5,060,739 A 10/1991 Griffin et al.
5,090,491 A 2/1992 Tibbitts et al.
5,318,351 A 6/1994 Walker
5,378,050 A 1/1995 Kammerer et al.
5,417,475 A 5/1995 Graham et al.
5,431,239 A 7/1995 Tibbitts et al.
5,605,382 A 2/1997 Massa et al.
5,649,604 A 7/1997 Fuller et al.
5,690,393 A 11/1997 Massa et al.
5,881,830 A 3/1999 Cooley
5,906,245 A 5/1999 Tibbitts et al.
6,089,123 A 7/2000 Chow et al.
6,213,931 B1 4/2001 Twardowski et al.
6,283,844 B1 9/2001 Tank
6,485,104 B1 11/2002 Keller et al.
6,779,850 B1 8/2004 Schibeci et al.
7,108,212 B2 9/2006 Latham
D558,802 S 1/2008 Nicholas
D616,003 S 5/2010 Ueda et al.
7,866,418 B2 1/2011 Bertagnolli et al.
7,998,573 B2 8/2011 Qian et al.
8,034,136 B2 10/2011 Sani
8,047,260 B2 11/2011 Uno et al.
8,079,785 B2 12/2011 Nicholas
8,236,074 B1 8/2012 Bertagnolli et al.
D666,640 S 9/2012 Cox et al.
8,567,533 B2 10/2013 Myers et al.
8,672,415 B2 5/2014 Neilson et al.
8,727,044 B2 5/2014 Qian et al.
8,789,894 B2 7/2014 Claesson et al.
9,017,438 B1 4/2015 Miess et al.
9,027,675 B1 5/2015 Jones et al.
9,028,008 B1 5/2015 Bookhamer et al.
9,238,893 B2 1/2016 Latham et al.
9,272,392 B2 3/2016 Mukhopadhyay et al.
9,272,814 B2 3/2016 Carver et al.
9,303,511 B2 4/2016 George et al.
9,382,794 B2 7/2016 Latham et al.
9,434,091 B2 9/2016 Burton et al.
9,487,847 B2 11/2016 Mukhopadhyay et al.
9,593,577 B2 3/2017 Lachmann et al.
D809,031 S 1/2018 Burton
10,018,041 B2 7/2018 Wachsmann et al.
10,316,660 B2 6/2019 Burton et al.
10,323,514 B2 6/2019 Burton et al.
10,414,069 B2 9/2019 Miess et al.
2001/0040053 A1 11/2001 Beuershausen et al.
2002/0153175 A1 10/2002 Ojanen et al.
2003/0234569 A1 12/2003 Dawood et al.
2005/0082898 A1 4/2005 Keller et al.
2006/0033379 A1 2/2006 Frear et al.
2006/0087169 A1 4/2006 Hesse et al.
2007/0090679 A1 4/2007 Ojanen et al.
2008/0030065 A1 2/2008 Frear et al.
2008/0035383 A1 2/2008 Hall et al.
2008/0036280 A1 2/2008 Hall et al.
2008/0202819 A1 8/2008 Fader
2008/0250724 A1 10/2008 Hall et al.
2008/0309146 A1 12/2008 Hall et al.
2009/0256413 A1 10/2009 Majagi
2010/0052406 A1 3/2010 Beach et al.
2010/0194176 A1 8/2010 Lucek et al.
2010/0244545 A1 9/2010 Hall et al.
2010/0326741 A1 12/2010 Patel
2011/0132667 A1 6/2011 Lai et al.
2011/0148178 A1 6/2011 Lehnert et al.
2011/0233987 A1 9/2011 Maushart et al.
2011/0266070 A1 11/2011 Scott et al.
2012/0043138 A1 2/2012 Myers et al.
2012/0138370 A1 6/2012 Mukhopadhyay
2012/0160573 A1* 6/2012 Myers ..... E21B 10/58 175/428
2012/0175939 A1 7/2012 O'Neill et al.
2012/0274123 A1 11/2012 Ball
2012/0279786 A1 11/2012 Cox
2013/0052481 A1 2/2013 Konyashin
2013/0092451 A1 4/2013 Mukhopadhyay et al.
2013/0092452 A1 4/2013 Mukhopadhyay et al.
2013/0322975 A1 12/2013 Tan et al.
2013/0341999 A1 12/2013 Hall et al.
2014/0110991 A1 4/2014 Sollami
2014/0175853 A1 6/2014 Warren
2014/0225418 A1 8/2014 Lachmann et al.
2014/0240634 A1 8/2014 Matsuzaki
2014/0339879 A1 11/2014 Burton et al.
2014/0339883 A1 11/2014 Burton et al.
2014/0368022 A1 12/2014 Torres Delgado et al.
2015/0035342 A1 2/2015 Jonker et al.
2015/0114727 A1 4/2015 Heuser
2015/0176408 A1 6/2015 Latham
2015/0176409 A1 6/2015 Latham
2015/0240635 A1 8/2015 Lachmann et al.
2015/0314483 A1 11/2015 Miess et al.
2016/0102550 A1 4/2016 Swope et al.
2016/0273356 A1 9/2016 Ojanen et al.
2016/0332269 A1 11/2016 Provins et al.

FOREIGN PATENT DOCUMENTS

CN 202073564 U 12/2011
CN 203081445 U 7/2013
GB 1481278 A 7/1977
GB 2170843 A 8/1986

(56) References Cited

FOREIGN PATENT DOCUMENTS

| | | | |
|---|---|---|---|
| GB | 2177144 | A | 1/1987 |
| GB | 2193740 | A | 2/1988 |
| WO | 2010083015 | A1 | 7/2010 |
| WO | 2012130870 | A1 | 10/2012 |
| WO | 2016071001 | A1 | 5/2016 |

OTHER PUBLICATIONS

Advisory Action for U.S. Appl. No. 14/275,574 dated Mar. 9, 2017.
Advisory Action for U.S. Appl. No. 14/811,699 dated Oct. 22, 2018.
Advisory Action for U.S. Appl. No. 15/266,355 dated Oct. 11, 2018.
Final Office Action for U.S. Appl. No. 14/266,437 dated Dec. 12, 2016.
Final Office Action for U.S. Appl. No. 14/266,437 dated Nov. 15, 2017.
Final Office Action for U.S. Appl. No. 14/266,437 dated Sep. 18, 2018.
Final Office Action for U.S. Appl. No. 14/273,360 dated Mar. 7, 2016.
Final Office Action for U.S. Appl. No. 14/275,574 dated Nov. 29, 2016.
Final Office Action for U.S. Appl. No. 14/811,699 dated Jul. 10, 2018.
Final Office Action for U.S. Application No. 15/238,486 dated Feb. 26, 2018.
Final Office Action for U.S. Appl. No. 15/266,355 dated Jul. 25, 2018.
Final Office Action for U.S. Appl. No. 15/266,355 dated May 9, 2019.
International Search Report and Written Opinion for International Application No. PCT/US2015/027830 dated Jul. 14, 2015.
International Search Report and Written Opinion from International Application No. PCT/US2014/037381 dated Oct. 30, 2014.
International Search Report and Written Opinion from International Application No. PCT/US2014/037708 dated Oct. 30, 2014.
Issue Notification for U.S. Appl. No. 14/273,360 dated Aug. 17, 2016.
Issue Notification for U.S. Appl. No. 14/275,574 dated May 29, 2019.
Issue Notification for U.S. Appl. No. 15/238,486 dated May 22, 2019.
Issue Notification for U.S. Appl. No. 29/540,584 dated Sep. 14, 2017.
Issue Notification for U.S. Appl. No. 29/540,597 dated Sep. 6, 2017.
Issue Notification for U.S. Appl. No. 29/555,279 dated Jan. 10, 2018.
Issue Notification for U.S. Appl. No. 29/555,281 dated Aug. 29, 2018.
Non-Final Office Action for U.S. Appl. No. 14/266,437 dated Jun. 9, 2016.
Non-Final Office Action for U.S. Appl. No. 14/266,437 dated Apr. 21, 2017.
Non-Final Office Action for U.S. Appl. No. 14/266,437 dated Jan. 8, 2019.
Non-Final Office Action for U.S. Appl. No. 14/266,437 dated Mar. 28, 2018.
Non-Final Office Action for U.S. Appl. No. 14/273,360 dated Oct. 22, 2015.
Non-Final Office Action for U.S. Appl. No. 14/275,574 dated Apr. 7, 2017.
Non-Final Office Action for U.S. Appl. No. 14/811,699 dated Jan. 4, 2019.
Non-Final Office Action for U.S. Appl. No. 14/811,699 dated Nov. 29, 2017.
Non-Final Office Action for U.S. Appl. No. 15/238,486 dated Aug. 17, 2017.
Non-Final Office Action for U.S. Appl. No. 15/266,355 dated Jan. 8, 2018.
Non-Final Office Action for U.S. Appl. No. 15/266,355 dated Nov. 29, 2018.
Non-Final Office Action for U.S. Appl. No. 16/406,673 dated Jun. 27, 2019.
Non-Final Office Action for U.S. Appl. No. 29/555,279 dated Mar. 24, 2017.
Notice of Allowance for U.S. Appl. No. 14/273,360 dated May 18, 2016.
Notice of Allowance for U.S. Appl. No. 14/266,437 dated May 2, 2019.
Notice of Allowance for U.S. Appl. No. 14/275,574 dated Feb. 12, 2019.
Notice of Allowance for U.S. Appl. No. 14/275,574 dated Jan. 24, 2018.
Notice of Allowance for U.S. Appl. No. 14/275,574 dated Jun. 15, 2018.
Notice of Allowance for U.S. Appl. No. 14/275,574 dated Oct. 11, 2018.
Notice of Allowance for U.S. Appl. No. 14/275,574 dated Sep. 26, 2017.
Notice of Allowance for U.S. Appl. No. 14/811,699 dated May 1, 2019.
Notice of Allowance for U.S. Appl. No. 15/238,486 dated Jan. 28, 2019.
Notice of Allowance for U.S. Appl. No. 15/238,486 dated Jun. 20, 2018.
Notice of Allowance for U.S. Appl. No. 15/238,486 dated Oct. 10, 2018.
Notice of Allowance for U.S. Appl. No. 29/540,584 dated May 8, 2017.
Notice of Allowance for U.S. Appl. No. 29/540,597 dated May 8, 2017.
Notice of Allowance for U.S. Appl. No. 29/555,269 dated Apr. 6, 2017.
Notice of Allowance for U.S. Appl. No. 29/555,279 dated Aug. 31, 2017.
Notice of Allowance for U.S. Appl. No. 29/555,281 dated Apr. 12, 2017.
Notice of Allowance for U.S. Appl. No. 29/555,281 dated Jan. 4, 2018.
Notice of Allowance for U.S. Appl. No. 29/555,281 dated May 16, 2018.
Notice of Allowance for U.S. Appl. No. 29/660,512 dated Apr. 25, 2019.
Restriction Requirement for U.S. Appl. No. 14/273,360 dated Jun. 12, 2015.
Roepke et al.; "Drag Bit Cutting Characteristics Using Sintered Diamond Inserts" Report of Investigations 8802; Bureau of Mines Report of Investigations/ 1983; (1983) 35 pages.
Supplemental Notice of Allowance for U.S. Appl. No. 14/273,360 dated Aug. 10, 2016.
Supplemental Notice of Allowance for U.S. Appl. No. 14/275,574 dated May 21, 2019.
Supplemental Notice of Allowance for U.S. Appl. No. 14/275,574 dated Oct. 31, 2018.
Supplemental Notice of Allowance for U.S. Appl. No. 15/238,486 dated Jun. 27, 2018.
Supplemental Notice of Allowance for U.S. Appl. No. 29/540,584 dated Sep. 7, 2017.
Supplemental Notice of Allowance for U.S. Appl. No. 29/540,597 dated Aug. 25, 2017.
Supplemental Notice of Allowance for U.S. Appl. No. 29/540,597 dated Jun. 1, 2017.
Supplemental Notice of Allowance for U.S. Appl. No. 29/555,269 dated Apr. 28, 2017.
Supplemental Notice of Allowance for U.S. Appl. No. 29/555,279 dated Jan. 2, 2018.
Supplemental Notice of Allowance for U.S. Appl. No. 29/555,281 dated Feb. 9, 2018.
Supplemental Notice of Allowance for U.S. Appl. No. 29/555,281 dated Jun. 12, 2017.
Supplemental Notice of Allowance for U.S. Appl. No. 29/555,281 dated Jun. 4, 2018.

(56) References Cited

OTHER PUBLICATIONS

U.S. Appl. No. 12/961,787, filed Dec. 7, 2010.
U.S. Appl. No. 13/027,954, filed Feb. 15, 2011.
U.S. Appl. No. 13/070,636, filed Mar. 24, 2011.
U.S. Appl. No. 13/100,388, filed May 4, 2011.
U.S. Appl. No. 13/275,372, filed Oct. 18, 2011.
U.S. Appl. No. 13/648,913, filed Oct. 10, 2012.
U.S. Appl. No. 13/765,027, filed Feb. 12, 2013.
U.S. Appl. No. 13/795,027, filed Mar. 12, 2013.
U.S. Appl. No. 14/266,437, filed Apr. 30, 2014.
U.S. Appl. No. 14/273,360, filed Mar. 7, 2016.
U.S. Appl. No. 14/273,360, filed May 8, 2014.
U.S. Appl. No. 14/275,574, filed May 12, 2014.
U.S. Appl. No. 14/811,699, filed Jul. 28, 2015.
U.S. Appl. No. 15/238,486, filed Aug. 16, 2016.
U.S. Appl. No. 16/406,673, filed May 8, 2019.
U.S. Appl. No. 29/540,584, filed Sep. 25, 2015.
U.S. Appl. No. 29/555,269, filed Feb. 19, 2016.
U.S. Appl. No. 29/555,279, filed Feb. 19, 2016.
U.S. Appl. No. 29/555,281, filed Feb. 19, 2016.
U.S. Appl. No. 61/824,007, filed May 16, 2013.
U.S. Appl. No. 61/824,022, filed May 16, 2013.
U.S. Appl. No. 62/030,525, filed Jul. 29, 2014.
U.S. Appl. No. 62/232,732, filed Sep. 25, 2015.
Final Office Action for U.S. Appl. No. 16/406,673, dated Dec. 26, 2019.
Issue Notification for U.S. Appl. No. 14/266,437 dated Aug. 28, 2019.
Issue Notification for U.S. Appl. No. 14/811,699 dated Aug. 21, 2019.
Issue Notification for U.S. Appl. No. 29/660,512 dated Aug. 28, 2019.
Non-Final Office Action for U.S. Appl. No. 16/526,387, dated Oct. 4, 2019.
Notice of Allowance for U.S. Appl. No. 15/266,355 dated Sep. 24, 2019.
Supplemental Notice of Allowability for U.S. Appl. No. 14/266,437 dated Aug. 19, 2019.
Advisory Action for U.S. Appl. No. 16/406,673 dated Mar. 6, 2020.
Final Office Action for U.S. Appl. No. 16/526,387 dated Apr. 22, 2020.
Issue Notification for U.S. Appl. No. 15/266,355 dated Apr. 22, 2020.
Non-Final Office Action for U.S. Appl. No. 16/406,673 dated Apr. 3, 2020.
Notice of Allowance for U.S. Appl. No. 15/266,355 dated Jan. 9, 2020.
Advisory Action for U.S. Appl. No. 16/526,387 dated Aug. 10, 2020.
Non-Final Office Action for U.S. Appl. No. 16/393,603 dated Aug. 6, 2020.
Non-Final Office Action for U.S. Appl. No. 16/526,387 dated Sep. 24, 2020.
Notice of Allowance for U.S. Appl. No. 16/406,673 dated Sep. 23, 2020.
Notice of Allowance for U.S. Appl. No. 16/526,387 dated Mar. 25, 2021.
Supplemental Notice of Allowance for U.S. Appl. No. 16/406,673 dated Apr. 27, 2021.

* cited by examiner

MATERIAL-REMOVAL SYSTEMS, CUTTING TOOLS THEREFOR, AND RELATED METHODS

CROSS-REFERENCE TO RELATED APPLICATIONS

This application is a continuation of U.S. application Ser. No. 14/811,699 filed on 28 Jul. 2015, which claims priority to U.S. Provisional Application No. 62/030,525 filed on 29 Jul. 2014, the disclosure of each of which is incorporated herein, in its entirety, by this reference.

BACKGROUND

Material-removal systems, such as mining machines, commonly use cutting tools or picks that engage and cut into target material. For example, cutting tools may be mounted on a rotatable mining head of the mining machine. While the mining head rotates, the mining machine and/or the mining head thereof may be advanced toward and into the target material. Hence, the cutting tools may engage, cut, or otherwise fail the target material as the mining head advances into the target material. Subsequently, the failed target material may be recovered or removed from its location, such as from a mine.

Particular target material may vary from one mining application to another. For example, mining machines may be used to fail and recover Trona or similar minerals and materials. In any event, operation of the mining machines typically results in wear of the cutting tools, which may lead to reduced useful life and reduced productivity as well as failure thereof, among other things.

Therefore, manufacturers and users continue to seek improved cutting tools and material-removal systems to extend the useful life thereof.

SUMMARY

Embodiments described herein relate to material-removal systems and cutting tools that may be used in the material-removal systems. More specifically, for example, the material-removal systems, and particularly the cutting tools thereof, may engage and fail target material. In some instances, the material-removal systems may be used in mining operations. Hence, the material-removal systems may mine the target material. In other words, For example, the material-removal systems may fail and remove or recover the failed target material (e.g., Trona).

At least one embodiment includes a material-removal system, which has a movable cutting head. The material-removal system includes a plurality of cutting tools mounted on the cutting head. Each of the plurality of cutting tools includes a tool body and a cutting element attached to the tool body. Each of the cutting elements has a substrate bonded to superhard table that includes a substantially planar working surface that is oriented at a back rake angle and a side rake angle. At least two of the plurality of cutting tools are positioned at different locations on the cutting head.

Embodiments also include a method of removing material. The method includes moving a plurality of cutting tools about a rotation axis. At least two of the plurality of cutting tools are positioned at different positions. Each of the plurality of cutting tools includes a substrate bonded to a superhard table that forms a working surface. Also, the superhard material forms at least a portion of a cutting end of the cutting tool. The method further includes advancing the plurality of cutting tools toward a target material. The method also include engaging the cutting ends and the working surfaces of the cutting tools with the target material, and thereby failing at least some of the target material while having the working surfaces oriented at back rake angle and at a side rake angle.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Embodiments described herein relate to material-removal systems and cutting tools that may be used in the material-removal systems. For example, the material-removal systems and, particularly, the cutting tools thereof may engage and fail target material. In some instances, the material-removal systems may be used in mining operations, such as to cut and mine Trona. In other words, For example, the material-removal system may fail and remove or recover the failed target material (e.g., Trona or other material).

Generally, the material-removal systems may include a rotatable cutting head and a plurality of cutting tools attached to the cutting head. Moreover, in an embodiment, at least some of the cutting tools may include superhard material. For example, the superhard material may form or define at least a portion of a working surface and/or at least a portion of a cutting end of the cutting tool. In particular, the working surface and/or the cutting end of the cutting tool may engage the target material (e.g., by plunging and/or cutting, and/or otherwise entering into and/or contacting the target material) and may fail the target material as the cutting head of the material-removal system rotates and/or advances into the target material.

Figure 1A:
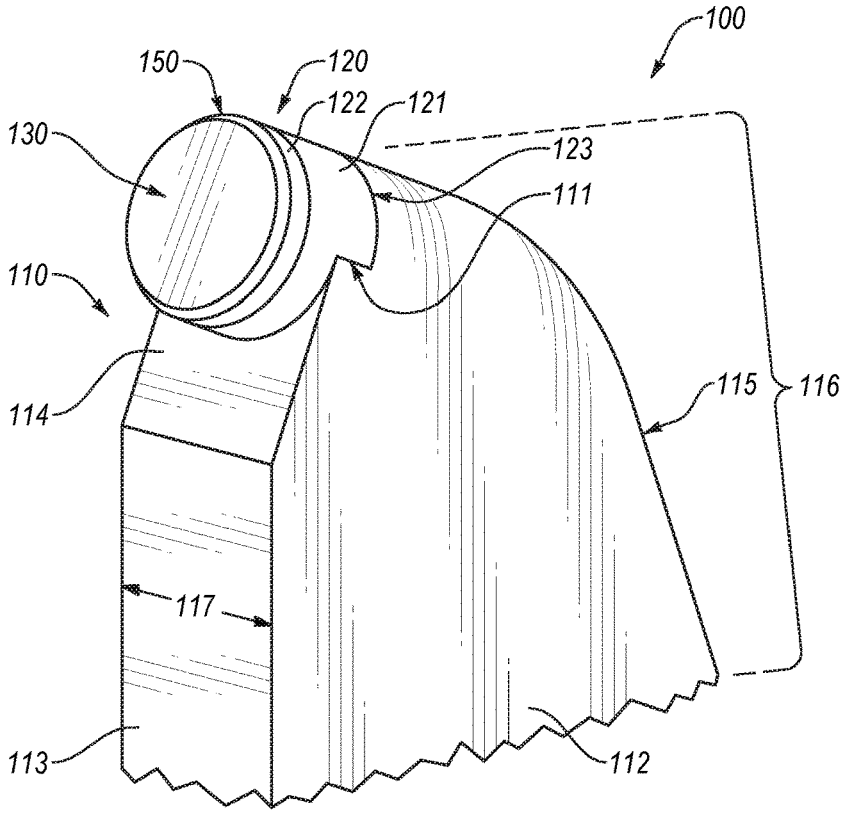
FIG. 1A is an isometric view of a cutting tool for a material-removal system according to an embodiment.
Figure 1B:
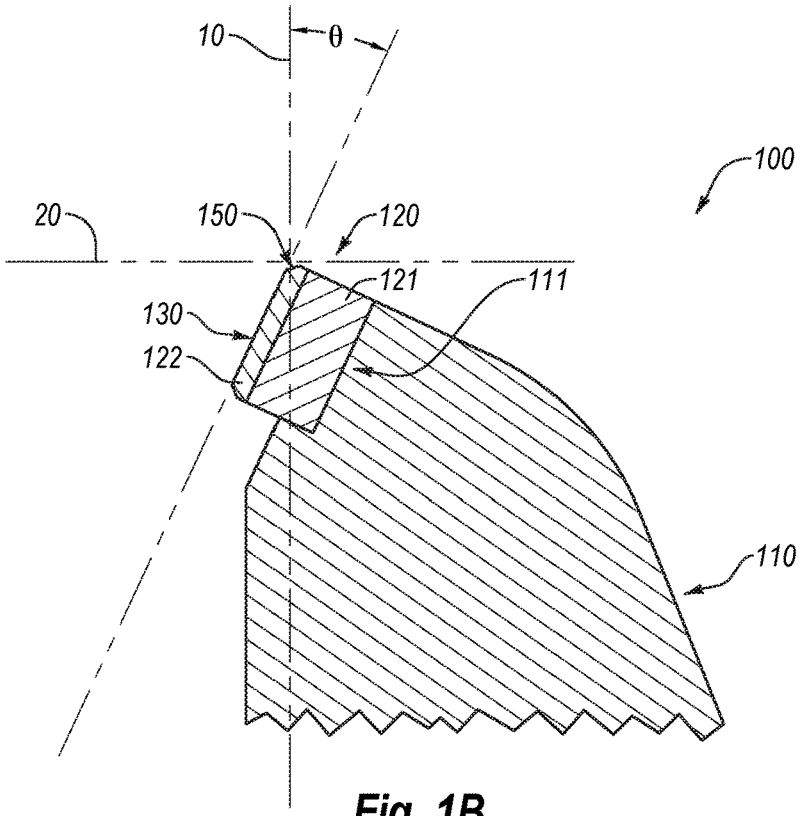
FIG. 1B is a cross-sectional view of the cutting tool of FIG. 1A.

FIGS. 1A-1B illustrate a cutting tool 100 according to an embodiment. For example, the cutting tool 100 may include a tool body 110 (partially shown) and cutting element 120 attached to the tool body 110. Generally, the cutting element 120 may be attached to the tool body 110 in any number of suitable ways and with any number of suitable mechanisms. More specifically, examples of attaching the cutting element 120 to the tool body 110 include brazing, press-fitting, fastening, combinations thereof, or the like.

In some embodiments, the cutting element 120 may include a substrate 121 and a superhard table 122 bonded to the substrate 121. For example, the substrate 121 may include cemented carbide, and the superhard table 122 may include polycrystalline diamond, as described below in more detail. Also, in one or more embodiments, the superhard table 122 may be bonded directly to the tool body 110, which in some instances may include cemented carbide. In any event, the superhard table 122 may include at least a portion of a working surface 130.

As described below in more detail, particular cutting element size, shape, configuration, or combinations thereof may vary from one embodiment to the next. In an embodiment, the cutting element 120 may have a 13 mm diameter and may be 13 mm thick. Alternatively, the cutting element 120 may be thicker or thinner than 13 mm. Likewise, in some instances, the cutting element 120 may have a diameter greater or less than 13 mm. In any event, the cutting element 120 may have a sufficient diameter and/or thickness to withstand operating conditions of the cutting tool 100. For example, a ratio of a width or diameter of the cutting element 120 to a thickness or height of the cutting element 120 may be at least one 1, greater than 1, about 1.2 to about 1.4, or about 1.0 to about 1.5.

In an embodiment, the superhard table 122 may include polycrystalline diamond and the substrate may comprise cobalt-cemented tungsten carbide. Furthermore, in any of the embodiments disclosed herein, the polycrystalline diamond table may be leached to at least partially remove or substantially completely remove a metal-solvent catalyst (e.g., cobalt, iron, nickel, or alloys thereof) that was used to initially sinter precursor diamond particles to form the polycrystalline diamond. In another embodiment, an infiltrant used to re-infiltrate a preformed leached polycrystalline diamond table may be leached or otherwise have a metallic infiltrant removed to a selected depth from a working surface. Moreover, in any of the embodiments disclosed herein, the polycrystalline diamond may be un-leached and include a metal-solvent catalyst (e.g., cobalt, iron, nickel, or alloys thereof) that was used to initially sinter the precursor diamond particles that form the polycrystalline diamond and/or an infiltrant used to re-infiltrate a preformed leached polycrystalline diamond table. Examples of methods for fabricating the superhard tables and superhard materials and/or structures from which the superhard tables and elements may be made are disclosed in U.S. Pat. Nos. 7,866,418; 7,998,573; 8,034,136; and 8,236,074; the disclosure of each of the foregoing patents is incorporated herein, in its entirety, by this reference.

The diamond particles that may be used to fabricate the superhard table in a high-pressure/high-temperature process ("HPHT)" may exhibit a larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger size (e.g., 70 μm, 60 μm, 50 μm, 40 μm, 30 μm, 20 μm, 15 μm, 12 μm, 10 μm, 8 μm) and another portion exhibiting at least one relatively smaller size (e.g., 15 μm, 12 μm, 10 μm, 8 μm, 6 μm, 5 μm, 4 μm, 3 μm, 2 μm, 1 μm, 0.5 μm, less than 0.5 μm, 0.1 μm, less than 0.1 μm). In an embodiment, the diamond particles may include a portion exhibiting a relatively larger size between about 10 μm and about 40 μm and another portion exhibiting a relatively smaller size between about 1 μm and 4 μm. In another embodiment, the diamond particles may include a portion exhibiting the relatively larger size between about 15 μm and about 50 μm and another portion exhibiting the relatively smaller size between about 5 μm and about 15 μm. In another embodiment, the relatively larger size diamond particles may have a ratio to the relatively smaller size diamond particles of at least 1.5. In some embodiments, the diamond particles may comprise three or more different sizes (e.g., one relatively larger size and two or more relatively smaller sizes), without limitation. The resulting polycrystalline diamond formed from HPHT sintering the aforementioned diamond particles may also exhibit the same or similar diamond grain size distributions and/or sizes as the aforementioned diamond particle distributions and particle sizes. Additionally, in any of the embodiments disclosed herein, the superhard cutting elements may be free-standing (e.g., substrateless) and/or formed from a polycrystalline diamond body that is at least partially or fully leached to remove a metal-solvent catalyst initially used to sinter the polycrystalline diamond body.

As noted above, the superhard table 122 may be bonded to the substrate 121. For example, the superhard table 122 comprising polycrystalline diamond may be at least partially leached and bonded to the substrate 121 with an infiltrant exhibiting a selected viscosity, as described in U.S. patent application Ser. No. 13/275,372, entitled "Polycrystalline Diamond Compacts, Related Products, And Methods Of Manufacture," the entire disclosure of which is incorporated herein by this reference. In an embodiment, an at least partially leached polycrystalline diamond table may be fabricated by subjecting a plurality of diamond particles (e.g., diamond particles having an average particle size between 0.5 μm to about 150 μm) to an HPHT sintering process in the presence of a catalyst, such as cobalt, nickel, iron, or an alloy of any of the preceding metals to facilitate intergrowth between the diamond particles and form a polycrystalline diamond table comprising bonded diamond grains defining interstitial regions having the catalyst disposed within at least a portion of the interstitial regions. The as-sintered polycrystalline diamond table may be leached by immersion in an acid or subjected to another suitable process to remove at least a portion of the catalyst from the interstitial regions of the polycrystalline diamond table, as described above. The at least partially leached polycrystalline diamond table includes a plurality of interstitial regions that were previously occupied by a catalyst and form a network of at least partially interconnected pores. In an embodiment, the sintered diamond grains of the at least partially leached polycrystalline diamond table may exhibit an average grain size of about 20 μm or less. Subsequent to leaching the polycrystalline diamond table, the at least partially leached polycrystalline diamond table may be bonded to a substrate in an HPHT process via an infiltrant with a selected viscosity. For example, an infiltrant may be selected that exhibits a viscosity that is less than a viscosity typically exhibited by a cobalt cementing constituent of typical cobalt-cemented tungsten carbide substrates (e.g., 8% cobalt-cemented tungsten carbide to 13% cobalt-cemented tungsten carbide).

Additionally or alternatively, the superhard table 122 may be a polycrystalline diamond table that has a thermally-stable region, having at least one low-carbon-solubility material disposed interstitially between bonded diamond grains thereof, as further described in U.S. patent application Ser. No. 13/027,954, entitled "Polycrystalline Diamond Compact Including A Polycrystalline Diamond Table With A Thermally-Stable Region Having At Least One Low-Carbon-Solubility Material And Applications Therefor," the entire disclosure of which is incorporated herein by this reference. The low-carbon-solubility material may exhibit a melting temperature of about 1300° C. or less and a bulk modulus at 20° C. of less than about 150 GPa. The low-carbon-solubility, in combination with the high diamond-to-diamond bond density of the diamond grains, may enable the low-carbon-solubility material to be extruded between the diamond grains and out of the polycrystalline diamond table before causing the polycrystalline diamond table to fail during operations due to interstitial-stress-related fracture.

In some embodiments, the polycrystalline diamond, which may form the superhard table, may include bonded-together diamond grains having aluminum carbide disposed interstitially between the bonded-together diamond grains, as further described in U.S. patent application Ser. No. 13/100,388, entitled "Polycrystalline Diamond Compact Including A Polycrystalline Diamond Table Containing Aluminum Carbide Therein And Applications Therefor," the entire disclosure of which is incorporated herein by this reference.

In some embodiments, the tool body 110 may include a recess 111 that may accept at least a portion of the cutting element 120 (e.g., at least a portion of the substrate 121 of the cutting element 120 may be positioned within the recess 111). Moreover, in some embodiments, the recess 111 may locate and/or orient the cutting element 120 relative to one or more features of the tool body 110 (e.g., relative to one or more surface of the tool body 110, such as a side surface 112, front surface 113, front slanted surface 114, etc.). As described below in more detail, For example, the recess 111 may orient the cutting element 120 in a manner that the working surface 130 forms one or more rake angles (e.g., a back rake angle and/or a side rake angle).

In some embodiments, the recess 111 in the tool body 110 may orient the cutting element 120 in a manner that forms the back and/or side rake of working surface 130. For example, the working surface 130 may be formed by the superhard table 122 and/or may be generally parallel to a back surface 123 of the substrate 121. Hence, to form the back rake and/or side rake angles, the recess 111 may orient the substrate 121 in a manner that orients the working surface 130 at a desired or suitable back and/or side rake angles.

Additionally or alternatively, in an embodiment, the working surface 130 may lie in a plane that is non-parallel relative to the back surface 123 of the substrate 121. For example, the superhard table 122 may be cut (e.g., wire EDM cut) or ground at an angle relative to the back surface 123 of the substrate 121 to produce a side and/or back rake angles. However, the side and/or back rake angles produced by orienting the working surface 130 at a non-parallel angle relative to the back surface 123 of the substrate 121 may be smaller or greater than a desired or suitable back and/or side rake angle. Hence, in some embodiments, the recess 111 may provide further orientation and/or location of the working surface 130, which is non-parallel to the back surface 123 of the substrate 121, in a manner that the recess 111 orients the working surface 130 to a desired and/or suitable back and/or side rake angles.

In an embodiment, a portion of the substrate 121 may be exposed outside of the recess 111 and/or tool body 110. For example, a top portion of the peripheral surface of the substrate 121 may be exposed and located outside of the tool body 110. Moreover, in an embodiment, at least part of the top portion of the peripheral surface of the substrate 121 may be, generally, tangent to a back surface 115 of the tool body 110 and/or may form an extension thereof. In other words, the back surface 115 of the tool body 110 may smoothly transition to the exposed portion of the peripheral surface of the substrate 121.

In some embodiments, the exposed portion of the substrate 121 may engage cuttings of the target material. Hence, for example, the exposed portion of the substrate 121 may erode or wear during operation of the cutting tool 100. Also, in some embodiments, the exposed portion of the substrate 121 may protect or shield at least a portion and/or one or more surfaces of the tool body 110 from wear during operation of the cutting tool 100. For example, the exposed portion of the substrate 121 may shield one or more portions of the tool body 110 from engagement with target material, which may increase useful life of the tool body 110 and the cutting tool 100.

In an embodiment, the working surface 130 may be substantially planar and/or may have a substantially circular shape (i.e., may be defined by a circular perimeter or boundary). Alternatively, the working surface may be non-planar (e.g., conical, bullet-shaped, etc.). Likewise, the general shape of the cutter element may vary from one embodiment to the next and may be generally cylindrical or non-cylindrical.

Also, the cutting tool 100 may include a cutting end 150. The cutting end 150 may define at least a portion of a perimeter or boundary of the working surface 130. Generally, in some embodiments, the cutting end 150 may be formed or defined at an edge region, which may be formed by and between two or more surfaces of the cutting element 120. For example, the cutting end 150 may be formed at an interface between the working surface 130 and a peripheral surface of the cutting element 120. It should be appreciated, however, that the cutting end may be formed at or include a surface, such as a chamfer, which may extend between two or more surfaces of the cutting element 120, as described below.

The working surface 130 and/or cutting end 150 may engage the target material. For example, the working surface 130 may penetrate into the target material, and movement of the working surface 130 and/or cutting end 150 within and/or against the target material may cut, grind, combinations thereof, or otherwise fail the target material. In some embodiments, the working surface 130 may be oriented at an angle relative to a longitudinal axis 10 (FIG. 1B), in a manner that forms a back rake angle θ with the longitudinal axis 10. The longitudinal axis 10 may be substantially perpendicular to a tangent line 20, where tangent line 20 is tangent (at an uppermost point of the cutting end 150) to a circular path along which the cutting tool 100 moves during rotation thereof.

For example, the back rake angle θ may be a negative back rake angle in one or more of the following ranges: about 1 degree to about 5 degrees; about 4 degrees to about 10 degrees; about 8 degrees to 20 degrees (e.g., greater than 17 degrees); and about 15 degrees to 30 degrees. In some embodiments, the back rake angle θ may be less than 1 degree or greater than 30 degrees. Moreover, as shown in FIGS. 1A-1B, according to an embodiment, the working surface 130 may have a negative back rake angle. Alternatively, however, as described below in more detail, the working surface may have a positive back rake angle (e.g., a back rake angle formed by the working surface 130 rotated clockwise from the longitudinal axis 10 is negative, while the back rake angle formed by the working surface 130 rotated counterclockwise from the longitudinal axis 10 is positive).

As described above, in an embodiment, the tool body 110 may include the slanted surface 114. For example, the slanted surface 114 may be approximately parallel to the working surface 130. Moreover, the slanted surface 114 may be offset from the working surface 130. In any event, the working surface 130 and/or the 114 may be oriented in a manner that facilitates movement or flow of the failed target material away from the cutting tool 100. For example, the failed target material may move or slide along the working surface 130 and away from the cutting end 150.

The tool body 110 may have any suitable shape and/or configuration, which may vary from one embodiment to the next. Generally, the tool body 110 may be configured to be attached to a cutting head of the material-removal system. In one or more embodiments, the tool body 110 may have an elongated portion 116, which may extend from an attachment portion (not shown) that may secure the cutting tool 100 to the cutting head of the material-removal system.

In some embodiments, the elongated portion 116 may have a width 117 that may be similar to or the same as the width or diameter of the cutting element 120. For example, the peripheral surface of the substrate 121 may not protrude past one or more of the side surfaces of the tool body 110 (e.g., side surface 112). Thus, according to an embodiment, matching the width of the cutting element 120 and tool body 110 may reduce drag experienced by the tool body 110 during movement in or through the target material.

Figure 2:
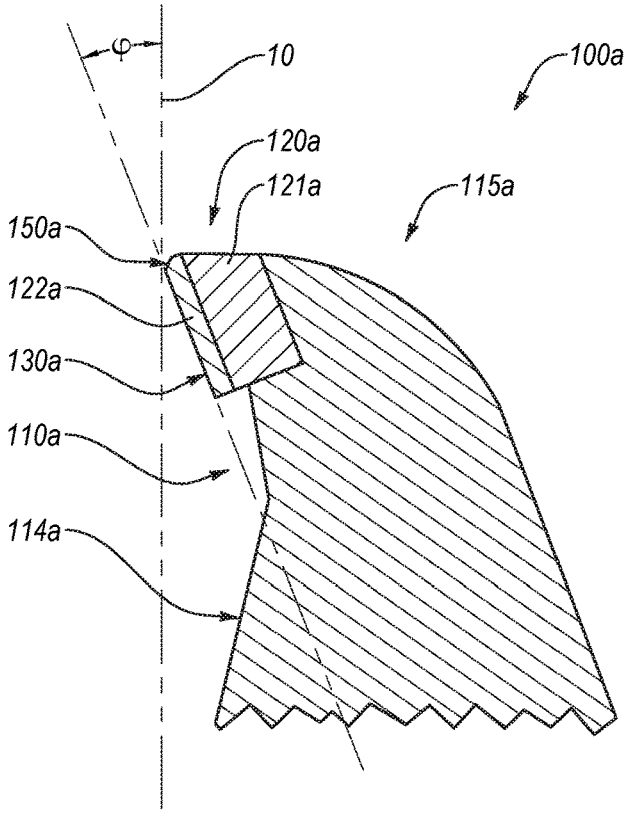
FIG. 2 is a cross-sectional view of a cutting tool for a material-removal system according to another embodiment.

While, as described above, the working surface 130 may form a negative back rake angle θ, in another embodiment, the working surface 130 may form a positive back rake angle. More specifically, FIG. 2 illustrates a cutting tool 100*a* according to an embodiment, which includes working surface 130*a* that has a positive back rake angle (p. Except as otherwise described herein, the cutting tool 100*a* and its materials, elements, or components may be similar to or the same as the cutting tool 100 (FIGS. 1A-1B) and its corresponding materials, elements, and components. For example, the cutting tool 100*a* may include a cutting element 120*a* that may be attached to a tool body 110*a*; the cutting element 120*a* may be similar to or the same as the cutting element 120 (FIGS. 1A-1B).

Particularly, in some embodiments, the back rake angle φ may be formed between the working surface 130*a* and a longitudinal axis 10. The magnitude of the back rake angle φ may be in one or more ranges described above in connection with back rake angle θ (FIG. 1B). In any event, the working surface 130*a* may be angled or oriented in a manner that facilitates flow or movement of failed target material away from the working surface 130*a* and/or from a cutting end 150*a*.

In some instances, the failed target material may move along the working surface 130*a* and toward the tool body 110*a*. Furthermore, in an embodiment, the tool body 110 may be configured to channel the failed target material away from the cutting tool 100 (e.g., away from the working surface 130*a* and/or cutting end 150*a*). For example, the tool body 110*a* may include one or more slanted surfaces, such as the slanted surface 114*a*, which may guide or channel failed target material away from the cutting tool 100. In other words, the failed target material may move across the working surface 130*a* and onto a portion of the tool body 110 (e.g., the slanted surface 114*a*), which may further guide or channel the failed target material away from the cutting tool 100*a*.

In one or more embodiments, the slanted surface 114*a* may be oriented at a non-parallel angle relative to the longitudinal axis 10 (i.e., the slanted surface 114*a* may be oriented at an obtuse or an acute angle relative to the longitudinal axis 10). Additionally or alternatively, the slanted surface 114*a* may have a non-parallel orientation relative to the working surface 130*a*. For example, the slanted surface 114*a* of the tool body 110*a* may be oriented at a non-parallel angle relative to the working surface 130*a*.

As described above, in some embodiments, the cutting element 120*a* may include a superhard table 122*a* bonded to a substrate 121*a*. Moreover, a portion of the substrate 121*a* may be exposed outside of the tool body 110*a*. For example, an upper portion of the peripheral surface of the substrate 121*a* may be exposed outside of the tool body 110*a*. In an embodiment, the exposed portion of the peripheral surface of the substrate 121*a* may extend from a back surface 115*a* of the tool body 110*a*. Furthermore, in some instances, the back surface 115*a* of the tool body 110*a* may smoothly transition to the exposed portion of the peripheral of the substrate 121*a*.

Figure 3:
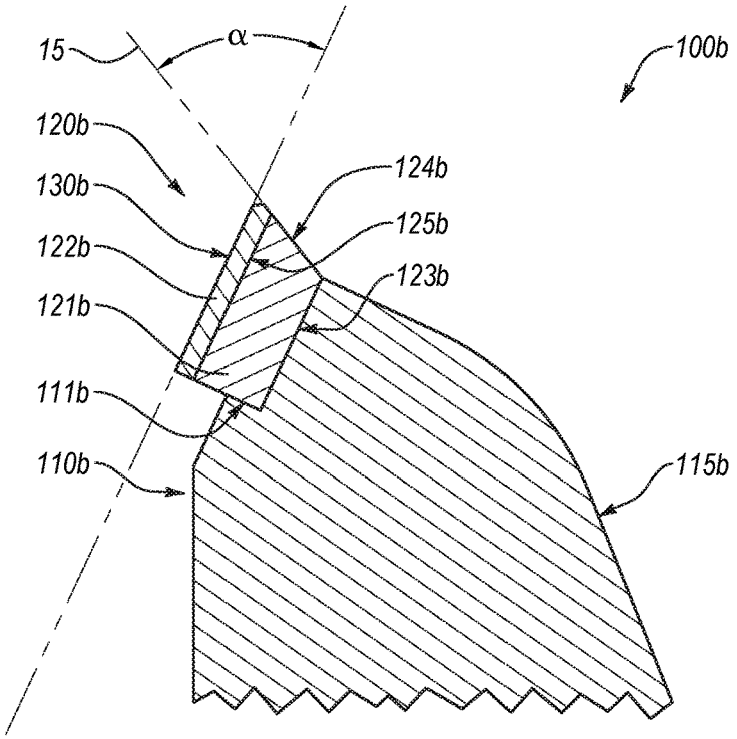
FIG. 3 is a cross-sectional view of a cutting tool for a material-removal system according to yet another embodiment.

Alternatively, in an embodiment, the back surface 115*a* of the tool body 110*a* may have a non-smooth transition (e.g., angled, stepped, uneven, etc.) between a back surface of the tool body and the exposed portion of the peripheral surface of the substrate. FIG. 3 illustrates a cutting tool 100*b*, which includes such a transition between back surface 115*b* of the tool body 110*b* and upper portion 124*b* of the peripheral surface 121*b*, according to an embodiment. Except as otherwise described herein, the cutting tool 100*b* and its materials, elements, or components may be similar to or the same as any of the cutting tools 100, 100*a* (FIGS. 1A-2) and their corresponding materials, elements, and components. For example, the cutting tool 100*b* may include a tool body 110*b* that may be similar to or the same as the tool body 110 (FIGS. 1A-1B).

In an embodiment, the cutting tool 100*b* may include a cutting element 120*b* secured to the tool body 110*b*. The cutting element 120*b* may include a superhard table 122*b* bonded to a substrate 121*b*. Moreover, in some examples, the cutting element 120*b* may be attached in a recess 111*b* of the tool body 110*b* (e.g., the substrate 121*b* of the cutting element 120 may be at least partially positioned within the recess 111*b*). As described above, at least a portion of the substrate 121*b* may be exposed out of the tool body 110*b*. In particular, for example, an upper portion 124*b* of the peripheral surface of the substrate 121*b* may be exposed outside of the tool body 110*b*.

In an embodiment, the upper portion 124*b* of the peripheral surface of substrate 121*b* may be tapered in a manner that forms a non-parallel angle α (e.g., acute or obtuse angle) with a working surface 130*b* of the cutting tool 100*b* (e.g., with the working surface 130*b* formed by the superhard table 122*b*). In an embodiment, at least a portion of the peripheral surface of the substrate 121*b* may have a tapered shape (e.g., a partially or completely conical shape). Also, For example, working surface 130*b* may form the angle α with a reference line 15, which may be substantially parallel to the cross-section of the peripheral surface of the substrate 121*b* at an uppermost location of the upper portion 124*b* thereof.

Tapering the upper portion 124*b* of the peripheral surface of the substrate 121*b* may facilitate clearance between the substrate 121*b* and the target material. Likewise, the taper of the upper portion 124*b* may provide clearance for failed material that may be between a new surface (formed after failing and/or removing target material) and the substrate 121*b*. Thus, in some embodiments, tapered upper portion 124*b* of the substrate 121*b* may increase useful life of the cutting tool 100*b*.

Generally, the angle α may vary from one embodiment to the next. In some embodiments, the angle α may be in one or more of the following ranges: about 15 degrees to 30 degrees; about 20 degrees to 45 degrees; about 40 degrees to 70 degrees; and about 50 degrees to 89 degrees. It should be appreciated that, in some embodiments, the angle α may be less than 15 degrees or greater than 89 degrees.

In some instances, the upper portion 124*b* of the substrate 121*b* may resemble and/or may define a chamfer. Moreover, the taper of the upper portion 124*b* of the substrate 121*b* may extend from a back surface 123*b* of the substrate 121*b* to an interface 125*b* between the substrate 121*b* and the superhard table 122*b*. Alternatively, the taper of the upper portion 124*b* may extend only part of the distance between the back surface 123*b* and the interface 125*b*.

For example, the taper may start and extend from the back surface 123*b* and terminate at a distance less than the distance between the back surface 123*b* and the interface 125*b* (e.g., the upper portion may include a step between the tapered portion and a non-tapered portion, which may extend from the tapered portion to the interface). Alternatively or additionally, a taper of the upper portion may extend from the interface and may terminate at a distance that is less than the distance between the interface 123*b* and the back surface 125*b*.

Furthermore, as described above, the cutting tool 100*b* may include a step or other discontinuity between a back surface 115*b* of the tool body 110*b* and the peripheral surface of the substrate 121*b* (e.g., the upper portion 124*b* of the peripheral surface). More generally, the portion of the peripheral surface of the substrate 121*b* extending from the back surface 115*b* may be incongruous with the adjacent portion of the back surface 115*b*. Accordingly, in some embodiments, the failed material that flows or moves along the upper portion 124*b* of the peripheral surface of the substrate 121*b* may change direction of movement as the material encounters the back surface 115*b* and may further move away from the substrate 121*b*.

In one or more embodiments, at least a portion of the peripheral surface of the superhard table 122*b* also may include a taper. For example, the taper of the peripheral surface of the superhard table 122*b* may generally form a continuation or extension of the taper formed on the upper portion 124*b* of the peripheral surface of the substrate 121 (i.e., the taper may form an angle with the working surface 130*b*). Hence, in some instances, the taper angle of the peripheral surface of the superhard table 122*b* may be in one or more ranges described above in connection with angle α. Also, in an embodiment, the taper of the peripheral surface of the superhard table 122*b* may be different from the taper of the peripheral surface of the substrate 121*b*.

In other embodiments, the substrate and/or superhard table may be tapered in a variety of other manners than those illustrated. For example, U.S. Pat. No. 5,881,830, which is incorporated herein in its entirety by this reference, discloses a variety of tapering geometries that may be employed in other embodiments.

Figure 4:
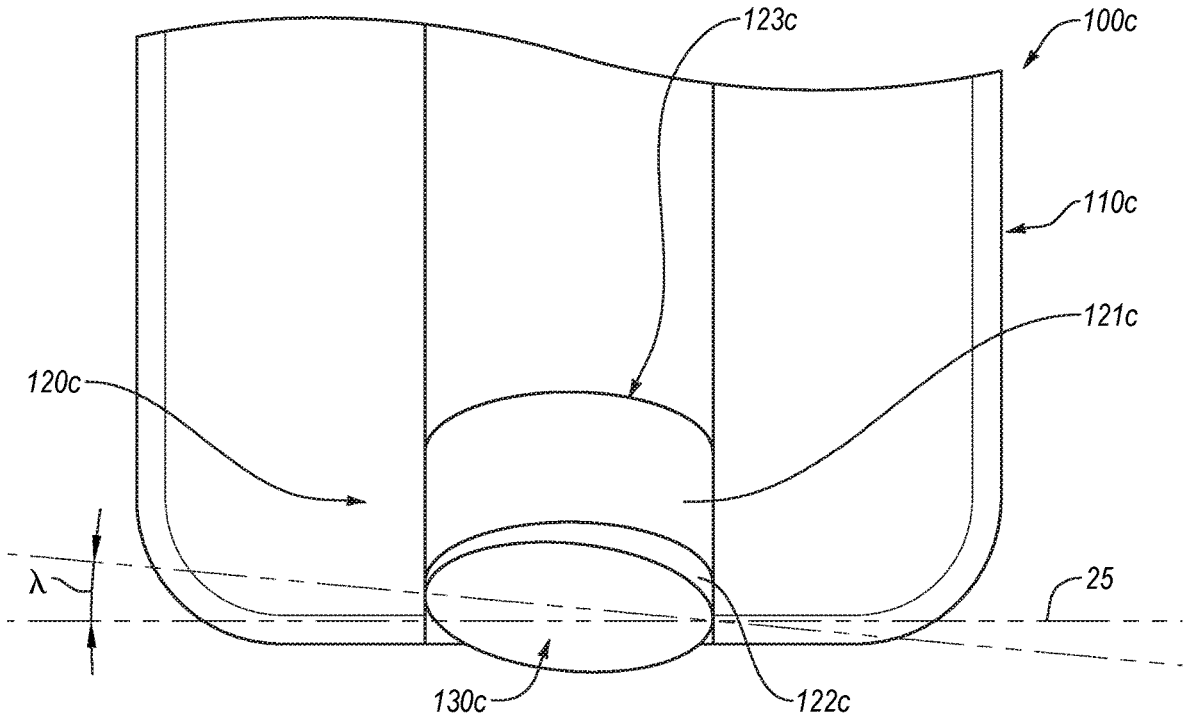
FIG. 4 is a top view of a cutting tool for a material-removal system according to one or more embodiments.

As mentioned above, the working surface may be oriented in a manner that forms a side rake angle during operation of the cutting tool. FIG. 4 illustrates a cutting tool 100*c* that includes a working surface 130*c*, which forms a side rake angle λ, according to an embodiment. Except as otherwise described herein, the cutting tool 100*c* and its materials, elements, or components may be similar to or the same as any of the cutting tools 100, 100*a*, or 100*b* (FIGS. 1A-3) and their corresponding materials, elements, and components. For example, the cutting tool 100*c* may include a tool body 110*c* that may be similar to or the same as the tool body 110 (FIGS. 1A-1B). In some embodiments, the cutting tool 100*c* may include a cutting element 120*c*, which may have a superhard table 122*c* bonded to a substrate 121*c*. Moreover, the superhard table 122*c* includes at least a portion of the working surface 130*c*. The cutting element 120*c* may be attached to the tool body 110*c*.

Figure 10:
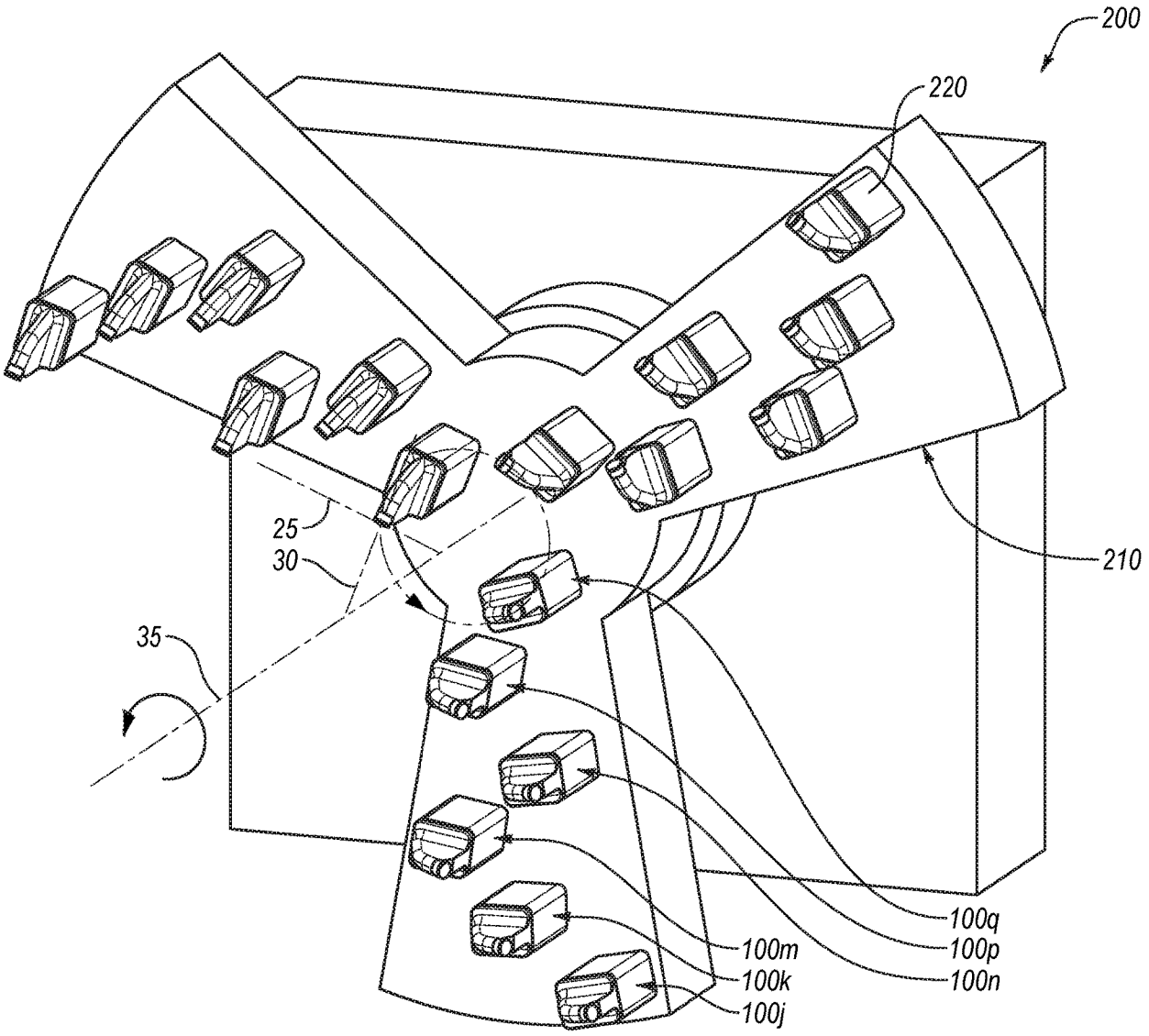
FIG. 10 is a schematic isometric view of a material-removal system according to an embodiment.

In an embodiment, the side rake angle λ may be formed between the working surface 130*c* and a reference line 25, which may be perpendicular to a path or direction of movement of the cutting tool 100*c* during operation thereof. For example, the reference line 25 may be an imaginary line extending between a rotation axis of the cutting head to which the cutting tool 100*c* is attached and a nearest point of working surface 130*c* wherein the imaginary line is substantially perpendicular to a rotation axis of the cutting head to which the cutting tool 100*c* is attached (e.g., as shown in FIG. 10, the reference line 25 may be perpendicular to a tangent line 30, which may be tangent to a radial path of the cutting tool rotating together with the cutter head). Generally, the side rake angle λ may vary from one embodiment to the next. For example, the side rake angle λ may be in one or more ranges described above in connection with back rake angle θ (FIG. 1A). Moreover, it should be appreciated that in addition to the side rake angle λ, the working surface 130*c* may be oriented at a back rake angle.

As noted above, the working surface 130*c* may be oriented relative to the tool body 110*c* at a desired or suitable side rake angle λ and/or back rake angle by orienting the working surface 130*c* at such angle relative to a back surface 123*c* of the substrate 121*c* or by orienting the pocket in which the cutting element is disposed. In an embodiment, a portion of the superhard table 122*c* may be thinner than another portion of the superhard table 122*c*. In particular, in some embodiments, the superhard table 122*c* may be a tapered (e.g., one side of the superhard table 122*c* may be thinner than another side of the superhard table 122*c*) in a manner that forms a suitable or desired angle between the working surface 130*c* and the back surface 123*c*. Moreover, the angle formed between the working surface 130*c* and the back surface 123*c* may be the same as the side rake angle λ and/or the back rake angle θ (described above). Thus, in some embodiments, the working surface 130*c* and the back surface 123*c* may exhibit selected angles with respect to different cross-sectional views taken through cutting element 120*c*.

Figure 5:
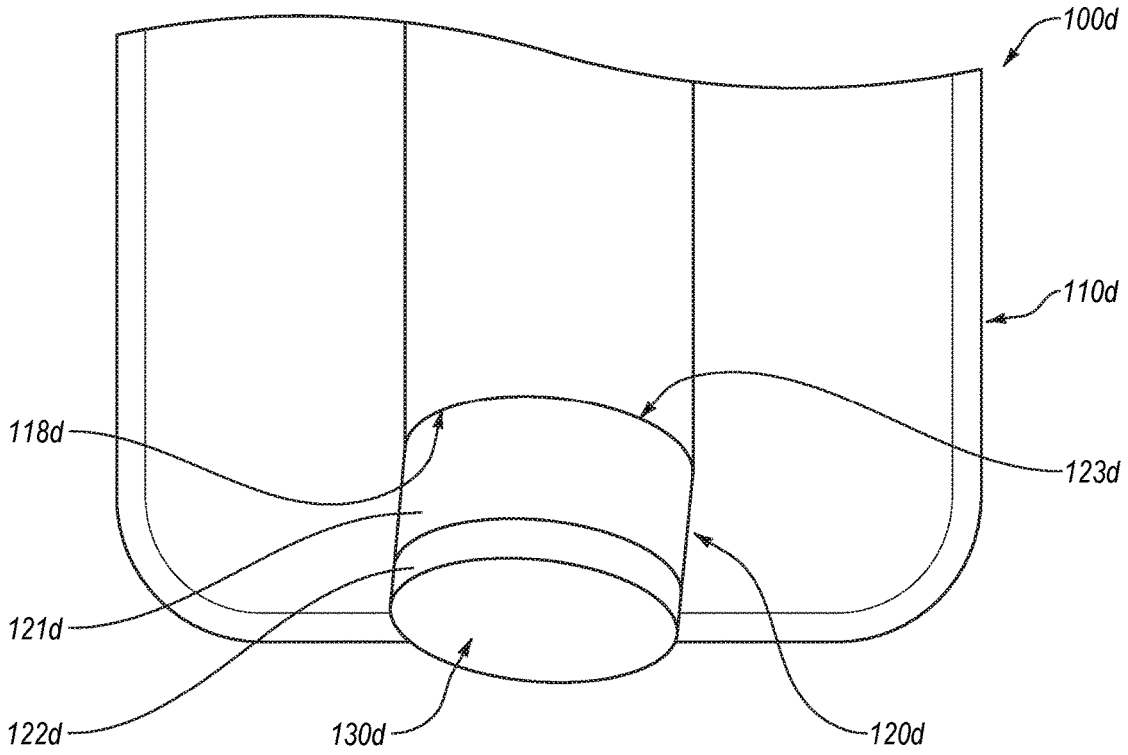
FIG. 5 is a top view of a cutting tool for a material-removal system according to one or more additional or alternative embodiments.

Alternatively, the back rake angle and/or the side rake angle may be formed by orienting the cutting element relative to the tool body. FIG. 5 illustrates a cutting tool 100*d* according to an embodiment, which includes such configuration. Except as otherwise described herein, the cutting tool 100*d* and its materials, elements, or components may be similar to or the same as any of the cutting tools 100, 100*a*, 100*b*, or 100*c* (FIGS. 1A-4) and their corresponding materials, elements, and components. For example, the cutting tool 100*d* may include a tool body 110*d* that may be similar to or the same as the tool body 110 (FIGS. 1A-1B).

In some embodiments, the cutting tool 100*d* may include a working surface 130*d* that is substantially parallel to a back surface 123*d* of a cutting element 120*d*. For example, the cutting element 120*d* may be attached to the tool body 110*d* of the cutting tool 100*d* and may provide the working surface 130*d* at a desired or suitable side and/or back rake angle. Furthermore, the cutting element 120*d* may include a substrate 121*d* and a superhard table 122*d* bonded to the substrate 121*d*, and the substrate 121*d* may include the back surface 123*d*.

In an embodiment, the back surface 123*d* may abut or contact a surface 118*d* of the tool body 110*d*. For example, the cutting element 120*d* may be secured in a recess (as described above), and the back surface 123*d* of the substrate 121*d* may be positioned and/or oriented by the surface 118*d* of the tool body 110*d*, which define a portion of the recess of the tool body 110*d*. Moreover, in some embodiments, the back surface 123*d* may be attached to the surface 118*d* of the tool body 110*d* (e.g., by brazing, etc.). In any event, in some embodiments, the surface 118*d* of the tool body 110*d* may position and/or orient the back surface 123*d*. Thus, according to an embodiment, the surface 118*d* of the tool body 110*d* may orient the working surface 130*d* at a suitable side rake angle and/or at a back rake angle. More specifically, in some embodiments, the superhard table 122*d* may have an approximately uniform thickness and/or the working surface 130*d* may be substantially parallel to the back surface 123*d*, and the surface 118*d* may orient the working surface 130*d* at a suitable side and/or back rake angle(s).

Figure 6:
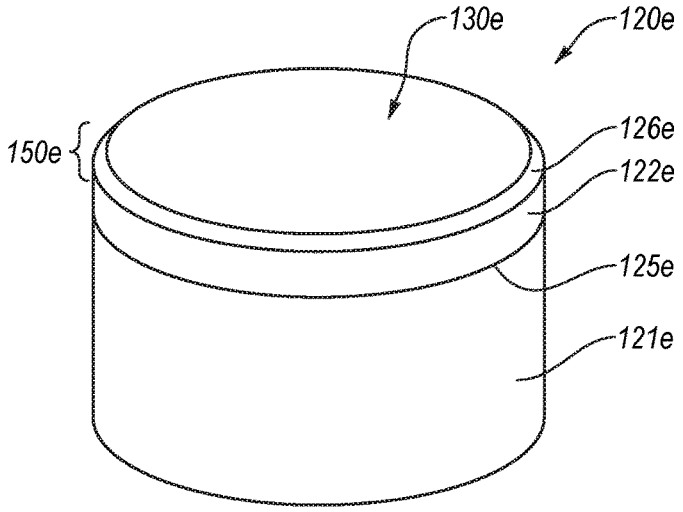
FIG. 6 is an isometric view of a cutting element for a cutting tool according to an embodiment.

Generally, in some embodiments, the cutting element may include a cutting end that may be formed by and between the peripheral surface of the superhard table and the working surface. In other words, the cutting end of the cutting element may be a substantially sharp corner between the working surface and the peripheral surface of the superhard table, which may facilitate penetration of the cutting element into the target material. In additional or alternative embodiments, the cutting element may include one or more chamfers that may at least partially surround the working surface, which may improve impact resistance or durability of the superhard table or cutting edge. FIG. 6 illustrates a cutting element 120*e* that includes a chamfer 126*e* that surrounds a working surface 130*e*, according to an embodiment.

Except as otherwise described herein, the cutting element 120*e* and its materials, elements, or components may be similar to or the same as any of the cutting elements 120, 120*a*, 120*b*, 120*c*, or 120*d* (FIGS. 1A-5) and their corresponding materials, elements, and components. For example, cutting element 120*e* may include a substrate 121*e* and a superhard table 122*e* that may be bonded to the substrate 121*e*; the substrate 121*e* and/or the superhard table 122*e* may be similar to the substrate 121 and superhard table 122 of the cutting element 120 (FIGS. 1A-1B). The cutting element 120*e* may include a cutting end 150*e* that may be defined or formed by: the chamfer 126*e*; an edge between the working surface 130*e* and the chamfer 126*e*; an edge between the chamfer 126*e* and superhard table 122*e*; or at least a portion of one or more of the foregoing. Accordingly, in some instances, the cutting end 150*e* may include at least a portion of an edge or corner and/or may include at least a portion of a surface (e.g., the surface formed by the chamfer 126*e*).

Also, under some operating conditions, the chamfer 126*e* may improve impact resistance or durability of the superhard table 122*e* and/or of the cutting end 150*e* (as compared with the cutting end formed at a sharp corner between the peripheral surface of the superhard table and the working surface). Furthermore, it should be appreciated that the size and/or orientation of the chamfer 126*e* may vary from one embodiment to the next. In some embodiments, the sharp edge between the working surface 130*e* and the peripheral surface of the superhard table 122*e* may be broken to form a relatively small chamfer 126*e* or radius (e.g., chamfer or radius of 0.001 inch, 0.005 inch, etc.). The chamfer 126*e*, however, may be larger if desired. For example, the chamfer 126*e* may be 0.05 inches, 0.10 inches, 0.15 inches, 0.020 inches, 0.030 inches, etc. Moreover, in some embodiments, the chamfer 126*e* may be larger than 0.05 inches.

In an embodiment, the working surface 130*e* may have an approximately circular shape. Consequently, the chamfer 126*e* also may have an approximately conical geometry (i.e., the chamfer 126*e* may encircle the working surface 130*e* and may define the shape and size of the working surface 130*e*). It should be appreciated, however, that a particular shape and/or size of the working surface 130*e* may vary from one embodiment to the next, as described below in further detail.

Figure 7:
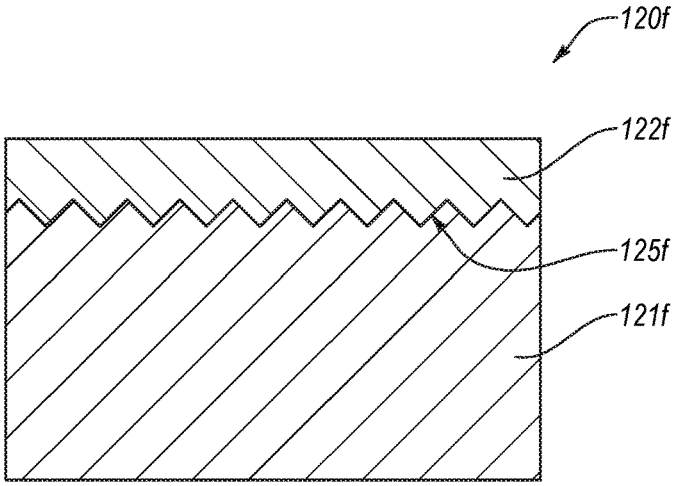
FIG. 7 is a cross-sectional view of a cutting element for a cutting tool according to another embodiment.

In some embodiments, working surface 130*e* may be substantially planar. Further, in some instances, the superhard table 122*e* may be bonded to the substrate 121*e* over a substantially planar interface 125*e*. In an embodiment, however, the superhard table may be bonded to the substrate over a nonplanar interface. FIG. 7 illustrates a cutting element 120*f* according to one or more alternative or additional embodiments. More specifically, in some examples, the cutting element 120*f* may include a superhard table 122*f* bonded to a substrate 121*f* over a nonplanar interface 125*f*. Except as otherwise described herein, the cutting element 120*f* and its materials, elements, or components may be similar to or the same as any of the cutting elements 120, 120*a*, 120*b*, 120*c*, 120*d*, 120*e* (FIGS. 1A-6) and their corresponding materials, elements, and components.

According to an embodiment, the interface 125*f* may include multiple corresponding and/or complementary grooves formed on the substrate 121*f* and superhard table 122*f*. In alternative or additional embodiments, a nonplanar interface between the superhard table the substrate may include any number of features, which may be complementary with one another, such that a feature protruding from the substrate may enter a recess in the superhard table and vice versa. In any event, in an embodiment, a nonplanar interface between the substrate a superhard table may improve impact resistance or durability of the cutting element (as compared with a cutting element that has a planar interface between the superhard table and the substrate).

Figure 8:
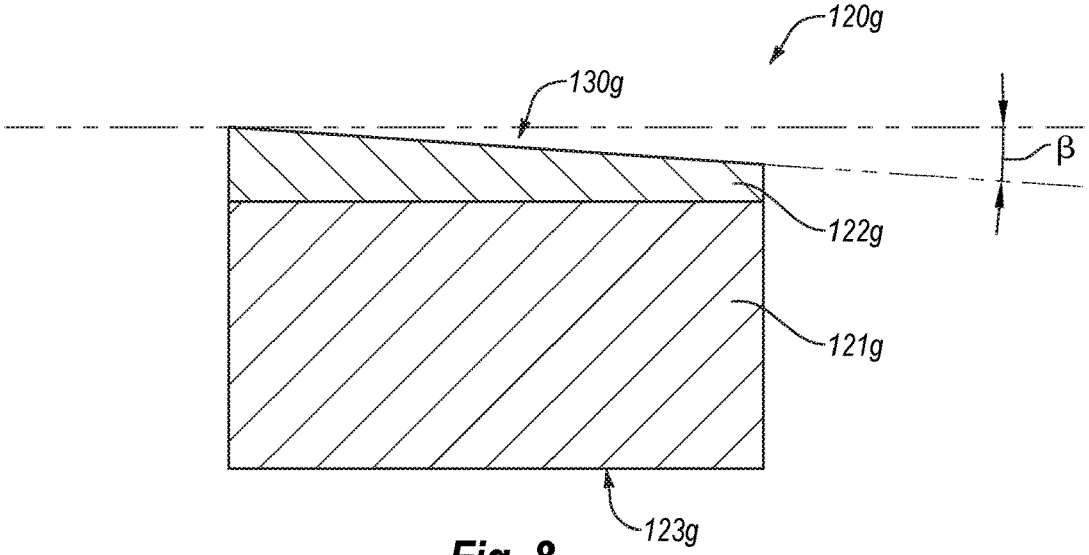
FIG. 8 is an cross-sectional view of a cutting element for a cutting tool according to yet another embodiment.

As described above, in some embodiments, a cutting element may include a working surface that is oriented at a nonparallel angle relative to a back surface of the cutting element. FIG. 8 illustrates a cutting element 120*g* that includes a working surface 130*g* that is oriented at a nonparallel angle relative to the back surface 123*g*, according to an embodiment. Except as otherwise described herein, the cutting element 120*g* and its materials, elements, or components may be similar to or the same as any of the cutting elements 120, 120*a*, 120*b*, 120*c*, 120*d*, 120*e*, 120*f* (FIGS. 1A-7) and their corresponding materials, elements, and components. For example, the cutting element 120*g* may include a superhard table 122*g* bonded to a substrate 121*g*, which may be similar to substrate 121 and superhard table 122 (FIGS. 1A-1B).

According to an embodiment, the cutting element 120*g* includes the working surface 130*g* that forms an angle β with the back surface 123*g*. More specifically, the angle β may form, at least to some extent, the side rake and/or back rake angle, as described above. Accordingly, in some embodiment, the cutting element 120*g* may be formed in a manner that predefines the side and/or back rake angles, depending on the orientation of the cutting element 120*g* (e.g., in addition to or in lieu of such angles being defined by the tool body).

Figure 9A:
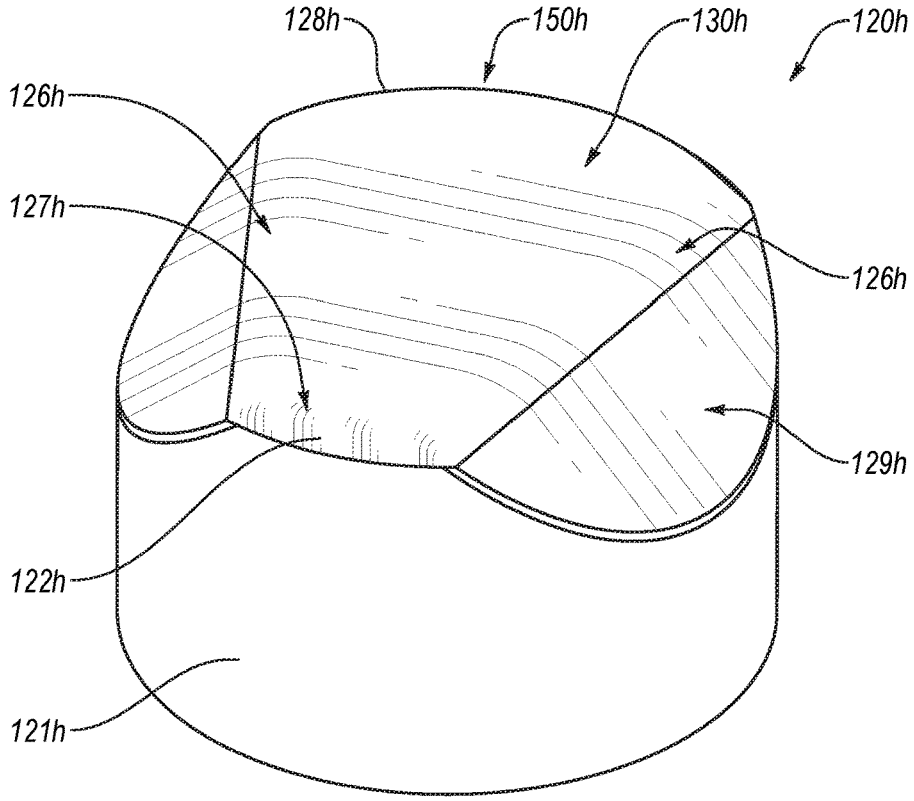
FIG. 9A is an isometric view of a cutting element for a cutting tool according to one other embodiment.
Figure 9B:
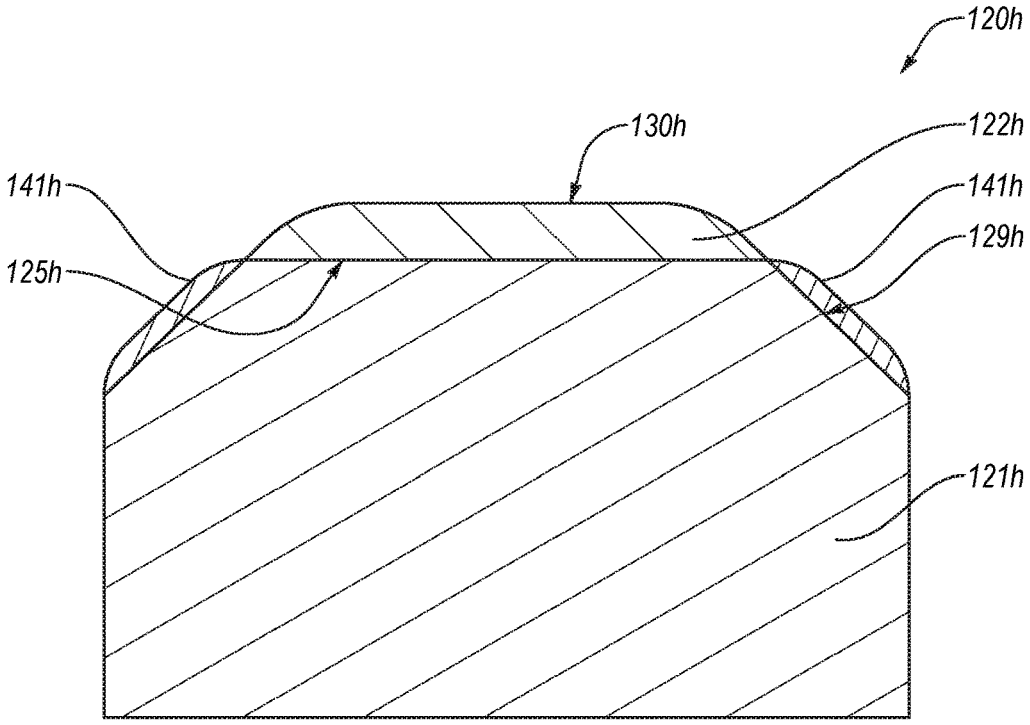
FIG. 9B is a cross-sectional view of the cutting element of FIG. 9A.

Also, in some embodiments, the cutting element may have non-circular working surface. FIGS. 9A-9B illustrate a cutting element 120*h* that includes a working surface 130*h*, which may have an approximately or generally trapezoidal shape, according to an embodiment. Except as otherwise described herein, the cutting element 120*h* and its materials, elements, or components may be similar to or the same as any of the cutting elements 120, 120*a*, 120*b*, 120*c*, 120*d*, 120*e*, 120*g*, or 120*h* (FIGS. 1A-8) and their corresponding materials, elements, and components. For example, the cutting element 120*h* may include a superhard table 122*h* bonded to a substrate 121*h*, which may be similar to the respective substrate 121 and superhard table 122 of the cutting element 100 (FIGS. 1A-1B).

In some embodiments, the working surface 130*h* may be bounded by one or more fillets or radii 126*h*, 127*h*, 128*h*, which may extend from the working surface 130*h* to a periphery of the superhard table 122*h* (e.g., to a peripheral surface of the superhard table 122*h*). As such, the radii 126*h*, 127*h*, 128*h* may define an approximately trapezoidal shape of the working surface 130*h*. For example, the radii 126*h* may define two opposing, sides of the trapezoidal shape of the working surface 130*h*. Additionally, the radii 126*h* and 128 may define two opposing sides of the trapezoidal shape of the working surface 130*h*.

Also, the cutting element 120*h* may include a cutting end 150*h* (e.g., the cutting end 150*h* may be formed by the radius 128*h*). It should be appreciated that the cutting element 120*h* may have a sharp corner or edge instead of the radius 128*h*. Accordingly, embodiments may include the cutting end 150*h* that is formed by a sharp corner, a chamfer, a radius, or combinations thereof. Moreover, in lieu of any of the radii 126*h*, 127*h*, 128*h* the cutting element 120*h* may include a shape edge.

The cutting element 120*h* may include one or more slanted surfaces, such as slanted surfaces 129*h*. For example, the slanted surfaces 129*h* may pass through an otherwise cylindrical shape of the cutting element 120*h*. Moreover, the slanted surfaces 129*h* may be included on a portion of the substrate 121*h* and/or of the superhard table 122*h*.

In the illustrated embodiment, one or more of the slanted surfaces 129*h* may include a protective coating 141*h* that may protect the slanted surfaces 129*h* from wear and/or damage during operation of the cutting tool. In other words, as the cutting element 120*h* engages the target material, the slanted surfaces 129*h* may contact the target material as well as the failed target material, which may wear or damage the slanted surfaces 129*h* in a manner that reduces the useful life of the cutting element 120*h*. Accordingly, protecting the slanted surfaces 129*h* from wear and/or damage may increase the useful life of the cutting element 120*h*. For example, the protective coating 141*h* may comprise titanium nitride (TiN), titanium aluminum nitride (TiAlN), chemical vapor deposited diamond, binderless tungsten carbide, similar coatings, or combinations thereof. In an embodiment, the binderless tungsten carbide layer may be formed by chemical vapor deposition ("CVD") or variants thereof (e.g., plasma-enhanced CVD, etc., without limitation). An example of a commercially available CVD tungsten carbide layer (currently marketed under the trademark HARDIDE®) is currently available from Hardide Layers Inc. of Houston, Tex. In other embodiments, a tungsten carbide layer may be formed by physical vapor deposition ("PVD"), variants of PVD, high-velocity oxygen fuel ("HVOF") thermal spray processes, or any other suitable process, without limitation. However, in other embodiments, the one or more protective coating 141*h* may be omitted and the substrate 121*h* may be exposed.

In an embodiment, the cutting element 120*h* may include a substantially planar interface 125*h* between the superhard table 122*h* and the substrate 121*h*. For example, the interface 125*h* may extend between the opposing slanted surfaces 129*h* (FIG. 9B). Hence, the superhard table 122*h* may extend between the uppermost edges of the slanted surfaces 129*h*.

It should be appreciated that any of the cutting tools described herein may include any of the cutting elements described herein. Moreover, any of the cutting elements may include one or more features or elements described herein in connection with any other cutting element. Also, as described above, any of the cutting tools described herein may be attached to a cutting head of a material-removal system.

FIG. 10 illustrates a material-removal system 200 according to an embodiment. More specifically, the material-removal system 200 may include a cutting head 210 that is rotatable about a rotation axis 35. Furthermore, the cutting head 210 includes a plurality cutting tools secured thereto. Specific arrangement of the cutting tools on the cutting head 210 may vary from one embodiment to the next. For example, the cutting head 210 may include cutting tools 100*j*-*q* secured thereto.

Figure 11:
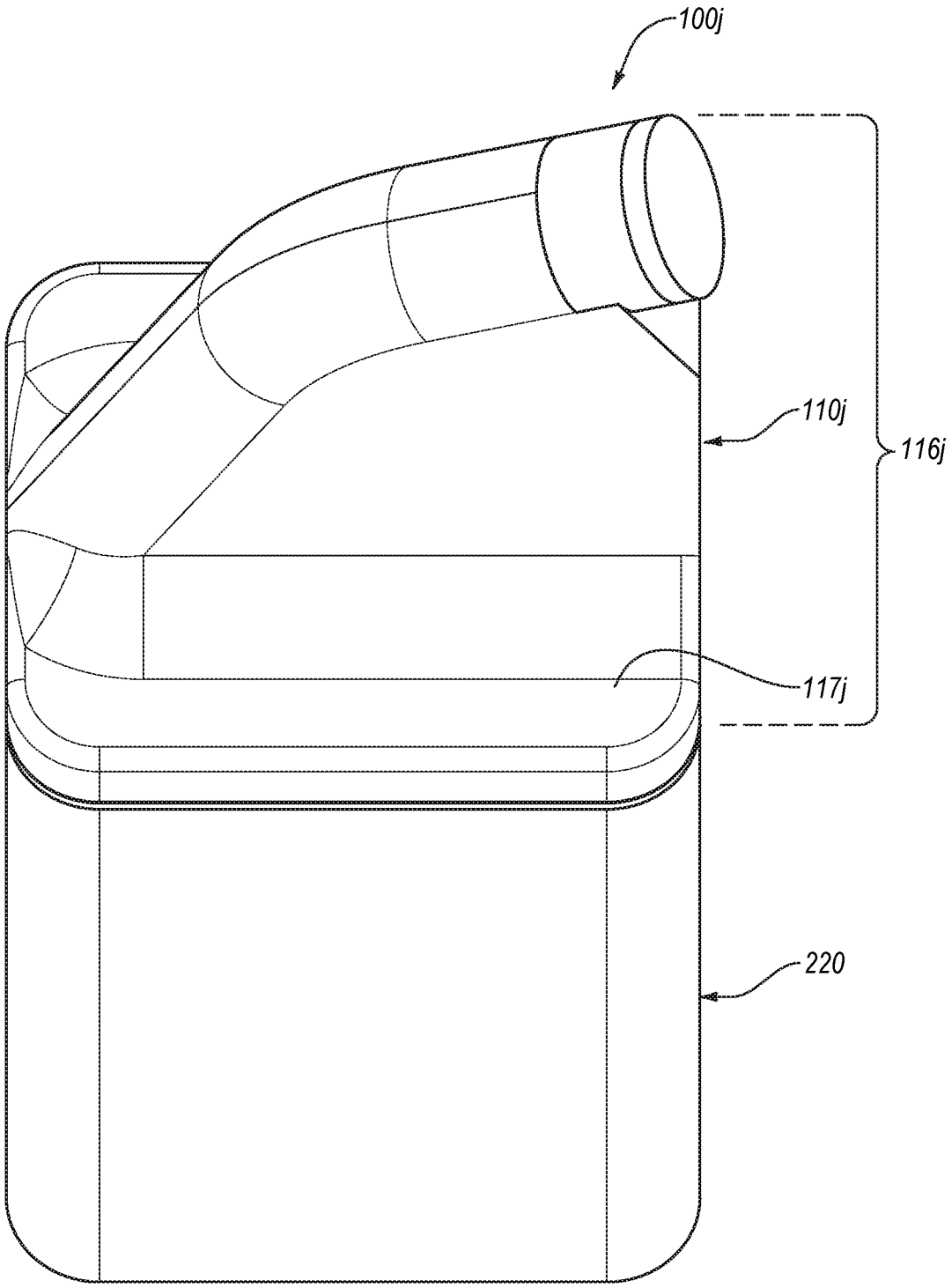
FIG. 11 is an isometric view of a cutting tool attached to a tool holder according to an embodiment.

For example, as shown in FIG. 11, the cutting tool 100*j* may be mounted on and/or attached to a holder 220. Generally, except as otherwise described herein, the cutting tool 100*j* and its materials, elements, or components may be similar to or the same as any of the cutting tools 100, 100*a*, 100*b*, 100*c*, 100*d* (FIGS. 1A-5) and their corresponding materials, elements, and components. In an embodiment, the cutting tool 110*j* may include a tool body 110*j* that has an elongated portion 116*j* projecting outward from a base portion 117*j*. For example, the tool body 110*j* and/or the elongated portion 116*j* may be similar to or the same as the tool bodies and/or elongated portions or elongated regions described in U.S. patent application Ser. No. 14/266,437, entitled "Cutting Tool Assemblies Including Superhard Working Surfaces, Material-Removing Machines Including Cutting Tool Assemblies, And Methods Of Use," filed on Apr. 30, 2014. In some embodiments, the tool body 110*j* may be similar to or the same as pick bodies described in U.S. patent application Ser. No. 14/275,574, entitled "Shear Cutter Pick Milling System," filed on May 12, 2014. Furthermore, in at least one embodiment, the tool body 110*j* may be similar to or the same as pick bodies described in U.S. patent application Ser. No. 14/273,360, entitled "Road-Removal System Employing Polycrystalline Diamond Compacts," filed on May 8, 2014. Each of the foregoing U.S. Patent Applications is incorporated herein in its entirety by this reference.

Referring back to FIG. 10, in some examples, the cutting head 210 may include multiple holders 220 that may secure the cutting tools 100*j*-*q*. The holders 220 may be attached to or integrated with the cutting head 210. In any event, in an embodiment, the cutting tools 100*j*-*q* may be attached to the cutting head 210 and may rotate together therewith about the rotation axis 35. Additionally, as described above, as the cutting head 210 rotates and advances toward and/or into the target material, the cutting tools 100*j*-*q* may also advance toward and/or into the target material, thereby cutting into and/or failing the target material (as the cutting head 210 rotates).

In an embodiment, the cutting tools 100*j*-*q* may include corresponding working faces that may generally face in the direction of rotation of the cutting head 210 and cutting tools 100*j*-*q* (as indicated by the arrow). Hence, the working surfaces and/or cutting ends of the cutting tools 100*j*-*q* may engage and fail the target material as the cutting head 210 rotates about the rotation axis 35. Moreover, as described above, the working surface may have back and/or side rake angles.

For example, the side rake angles of one, some, or all of the cutting tools 100*j*-*q* may open toward the rotation axis 35 or away therefrom. In other words, in some embodiments, at least some of the working faces may have a side rake angle that faces toward the rotation axis 35, such that the portion of the working face that is farthest from an imaginary radius line is closer to the rotation axis 35 than the portion of the working surface that is closest to an imaginary radius line. Conversely, in an embodiment, at least some of the working faces may have a side rake angle that faces away from the rotation axis 35, such that the portion of the working face that is closest to an imaginary radius line is closer to the rotation axis 35 than the portion of the working surface that is farthest from the imaginary radius line In some embodiments, two or more of the cutting tools 100*j*-*k* may have different positions or locations one from another relative to the rotation axis 35. In other words, two or more of the cutting tools 100*j*-*k* may have different radial spacing one from another. For example, the cutting tools 100*j* may be spaced farther away from the rotation axis 35 than cutting tools 100*k*-*q*.

In an embodiment, the cutting tools 100*j*-*q* may be the same or substantially the same (e.g., the cutting tools 100*j*-*q* may include the same or similar cutting elements). Alternatively, one or more of the cutting tools 100*j*-*q* may be different from other cutting tools 100*j*-*q*. In one or more embodiments, the cutting tools 100*j*-*k* may vary depending on their respective radial position relative to the rotation axis 35.

For example, the cutting tools located closer to the rotation axis 35 may have a larger side and/or back rake angle than the cutting tools located farther from the rotation axis 35. For example, the side and/or back rake angles of the working surfaces may increase as the distance from the rotation axis of the cutting tool decreases (i.e., as the radial path of the cutting tool in operation decreases). More specifically, in an embodiment, the cutting tools 100*q* may include working surface that have larger side rake angles than the working surfaces of the cutting tools 100*j*, which may be located at a position that is farther away from the rotation axis 35 than the cutting tools 100*q*.

In one or more embodiments, impact resistance of the cutting elements of the cutting tools 100*j*-*q* may vary with distance from the rotation axis 35. More specifically, in an embodiment, the cutting tools located closer to the rotation axis 35 may have cutting elements that have greater impact resistance than the cutting tools that are located farther away from the rotation axis 35. For example, the cutting tools 100*q* may include cutting elements that have a higher impact resistance that cutting elements of the cutting tools 100*j*.

As described above, the cutting elements that include a chamfer that forms a cutting end, and which at least partially surrounds the working surface may have an increased impact resistance (as compared with cutting elements that have a sharp edge in lieu of a chamfer). Also, cutting elements that have a nonplanar interface between the substrate and superhard table may have increased impact resistance (as compared with cutting elements that have a planar interface). Accordingly, in some embodiments, some of the cutting tools located closer to the rotation axis 35 may include cutting elements that include a chamfer and/or a nonplanar interface (superhard table to substrate interface), while some of the cutting tools located farther from the rotation axis 35 may include cutting elements that do have a sharp edge (in lieu of a chamfer) and/or planar substrate to superhard table interface.

For example, one, some, or all of the cutting tools 100*q* may include cutting elements that have a chamfer and/or nonplanar interface. Additionally, for example, one, some, or all of the cutting tools 100*j* may include cutting elements that have a sharp edge (in lieu of a chamfer) and/or planar substrate to superhard table interface. Moreover, in some embodiments, sizes of chamfers may vary with distance of the cutting tools from the rotation axis 35. In an example, the closer the cutting tool to the rotation axis 35, the larger may be the chamfer included on the cutting element (e.g., the cutting tools 100*j* may have a chamfer of about 0.01 inch, while the cutting tools 100*q* may have a chamfer of about 0.10 inch). It should be also appreciated that impact resistance of the cutting elements may be varied by varying diamond grain size of the polycrystalline diamond superhard table (e.g., cutting tools closer to the rotation axis 35 may have diamond tables with smaller grain size, and cutting tools farther away from the rotation axis 35 may have diamond tables with larger grain size).

Figure 12:
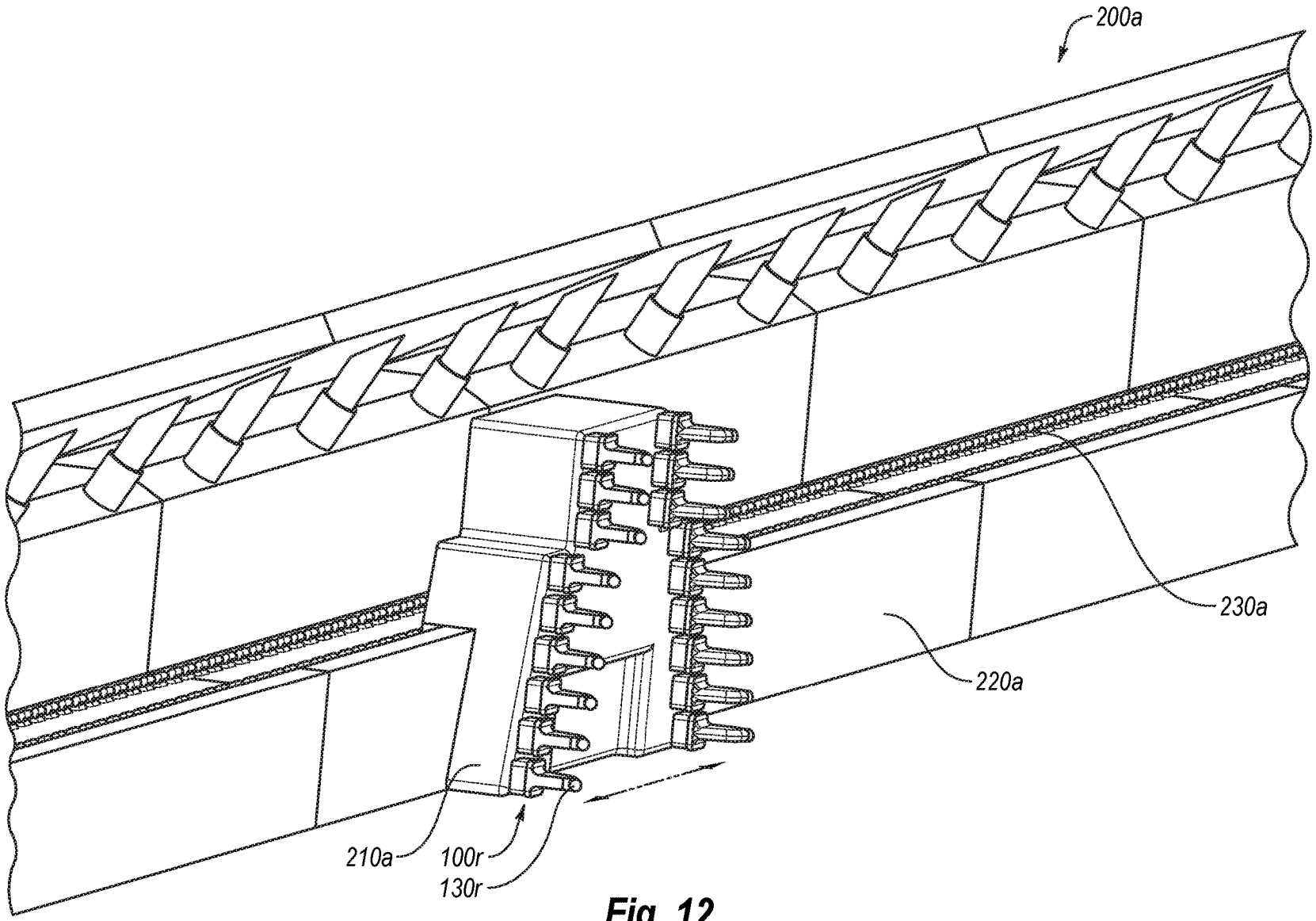
FIG. 12 is an isometric view of a long-wall material-removal system according to at least one embodiment.

While in some embodiments the material-removal system may include a bore mining head or bore mining machine, which may bore into the target material, the present disclosure is not so limited. Specifically, for example, the material-removal system may be a long-wall material-removal system, such as a chain system, drum system, plow system, etc., that may move along a wall and may remove the target material therefrom during such movement. FIG. 12 illustrates a long-wall material-removal system 200*a* according to at least one embodiment. Except as otherwise described herein, the material-removal system 200*a* and its materials, elements, or components may be similar to or the same as the material-removal system 200 (FIG. 10) and its corresponding materials, elements, and components. Furthermore, the material-removal system 200*a* may include any cutting tool and/or combination of the cutting tools described herein.

In an embodiment, the material-removal system 200*a* may include multiple cutting tools 100*r* (not all labeled) mounted to a cutting head 210*a*. For example, the cutting head 210*a* may be advanced linearly and the cutting tools 100*r* may engage, cut, scrape, or otherwise fails and/or remove target material during advancement of the cutter head 210*a*. In at least one embodiment, the cutter head 210*a* may be slideably or movably mounted on an elongated support member 220*a* and may be advance generally linearly along the elongated support member 220*a* (e.g., in first and/or second directions, as indicated with arrows). In some embodiments, the material-removal machine 200*a* may include a chain 230*a* (or a similar movable attachment), which may be connected to the cutter head 210*a* and to an advancement mechanism, such as a motor. In an embodiment, the chain 230*a* may advance the cutter head 210*a* in the first and/or second directions, thereby engaging the target material with the cutting tools 100*r* and removing the target material.

In some embodiments, the cutting tools 100*r* may include corresponding working surfaces 130*r* (not all labeled), which may engage the target material. In an example, at least some of the working surfaces 130*r* may generally face in the direction of movement of the cutter head 200*a*. As mentioned above, the cutter head 210*a* may move in the first and second directions. According to at least one embodiment, at least some of the working surfaces 130*k* may generally face in the first direction, and at least some of the working surfaces may general face in the second direction.

Figure 13:
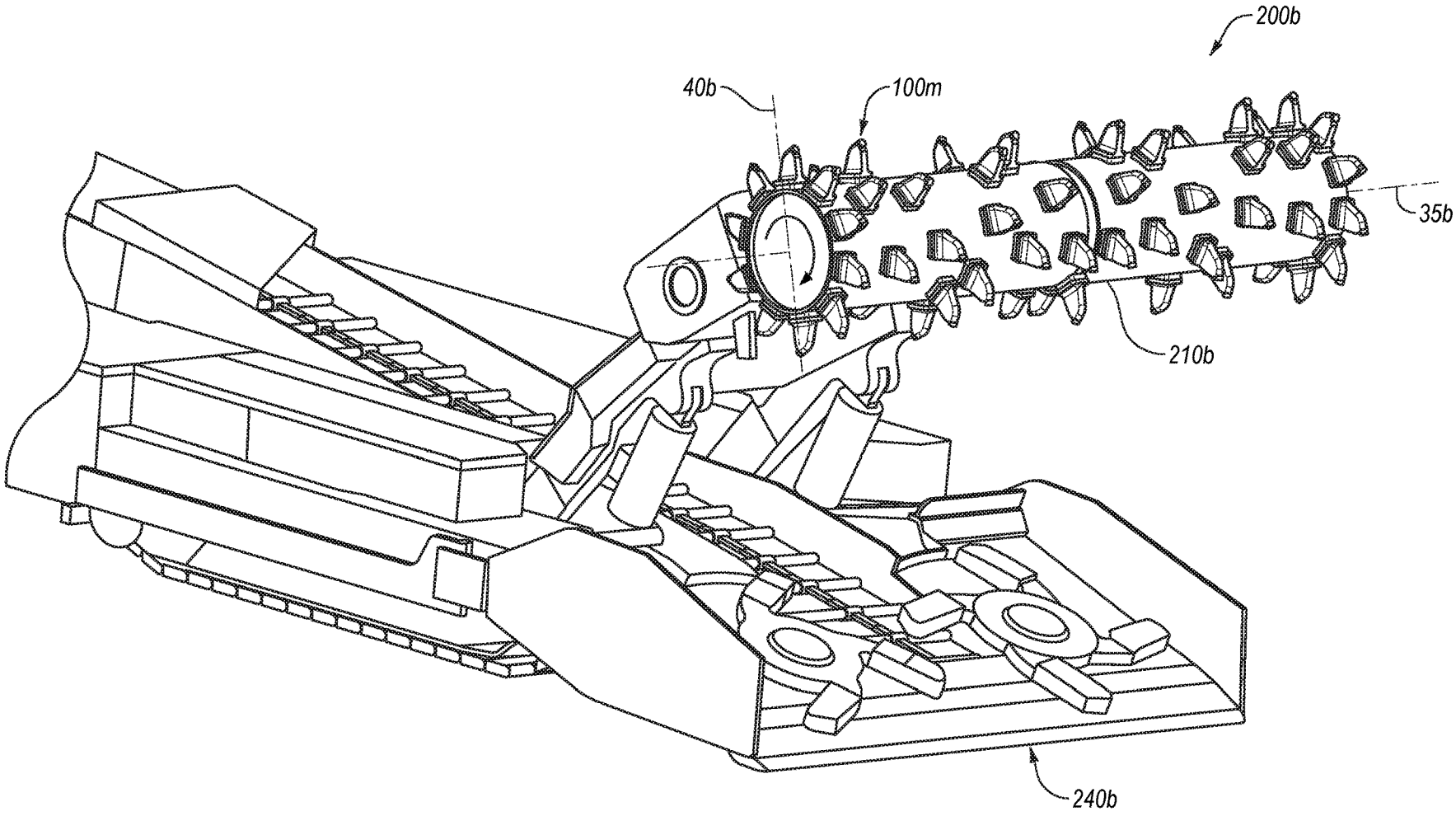
FIG. 13 is an isometric view of a material-removal system that include a cutter head that may rotate about rotation axis and/or move linearly along a vertical axis according to an embodiment.

In some embodiments, the material-removal system may produce linear movement and/or rotation of the cutting tools. FIG. 13 illustrates an embodiment of a material-removal system 200*b* that include a cutter head 210*b* that may rotate about rotation axis 35*b* and/or move at least partially vertically (e.g., generally radially in a direction 40*b* that is substantially perpendicular to the rotation axis 35*b* or vertically with no radial movement). Except as otherwise described herein, the material-removal system 200*b* and its materials, elements, or components may be similar to or the same as any of the material-removal systems 200, 200*a* (FIGS. 10, 12) and its corresponding materials, elements, and components. Furthermore, the material-removal system 200*a* may include any cutting tool and/or combination of the cutting tools described herein.

In an embodiment, the cutting head 210*b* may include multiple cutting tools 100*m* secured thereto. For example, the cutting tools 100*m* may generally extend outward and away from the rotation axis 35*b*. In some embodiments, working surfaces of the cutting tools 100*m* may face generally in the direction of rotation (e.g., as indicated with the arrows).

In some examples, the material-removal system 200*b* may include a material removal ramp 240*b*. Failed target material may be swept or otherwise moved onto the ramp 240*b* and may be removed from site of operations by the material-removal system 200*b*. It should be also appreciated that the cutting tools described herein may be mounted on any suitable cutting head or included in a material-removal system, and the specific examples of material-removal systems described herein are for illustrative purposes and are not intended to be limiting.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A material-removal system, comprising:

a movable cutting head; and a plurality of cutting tools mounted on the cutting head, each of the plurality of cutting tools including:

a tool body having a front surface, a front slanted surface extending from the front surface, a back surface;

a pocket formed in the tool body between the front slanted surface and the back surface, the pocket comprising a first surface and a second surface; and a cutting element attached to the tool body to secure the cutting element at least partially within the pocket, the cutting element having a substrate and a superhard table that includes a substantially planar working surface offset from the front slanted surface and oriented at a back rake angle with respect to a longitudinal axis of the tool body and a side rake angle, the substrate including a back surface opposite to the superhard table;

wherein the first surface extends from the front slanted surface, is shaped complementary to a portion of the substrate, and is adjacent to only a portion of a side surface of the substrate, and the second surface extends from the back surface of the tool body and is adjacent to the back surface of the substrate.

2. The material-removal system of claim 1, wherein at least one of the plurality of cutting tools has a different side rake angle than other cutting tools of the plurality of cutting tools.

3. The material-removal system of claim 2, wherein the cutting element of a first cutting tool of the plurality of cutting tools has a larger side rake angle than the cutting element of a second cutting tool of the plurality of cutting tools, and the first cutting tool is located closer to a rotation axis of the movable cutting head than the second cutting tool.

4. The material-removal system of claim 1, wherein at least some of the cutting elements of the plurality of cutting tools include a nonplanar interface between the superhard table and the substrate thereof.

5. The material-removal system of claim 4, wherein the superhard table and the substrate include one or more complementary grooves and protrusions that form the nonplanar interface therebetween.

6. The material-removal system of claim 1, wherein at least some of the cutting elements of the plurality of cutting tools include a chamfer at least partially surrounding the substantially planar working surface.

7. The material-removal system of claim 6, wherein the superhard table of a first cutting tool of the plurality of cutting tools has a larger chamfer than the superhard table of a second cutting tool of the plurality of cutting tools, and the first cutting tool is located closer to a rotation axis of the movable cutting head than the second cutting tool.

8. The material-removal system of claim 1, wherein one or more of the back rake angle or side rake angle is from 15 degrees to 20 degrees and the superhard table has a greater thickness on a first side than a second side to form the back rake angle and the side rake angle.

9. The material-removal system of claim 1, wherein the back rake angle is 15 degrees to 20 degrees.

10. The material-removal system of claim 1, wherein the back rake angle is a negative back rake angle.

11. The material-removal system of claim 1, wherein the side rake angle is 15 degrees to 20 degrees.

12. The material-removal system of claim 1, wherein the substantially planar working surface has a trapezoidal shape.

13. The material-removal system of claim 1, wherein:

the second surface is substantially parallel to the substantially planar working surface;

the substrate of each of the cutting elements extends from the pocket past the front slanted surface; and the tool body of each cutting tool of the plurality of cutting tools includes:

an elongated portion having a width substantially equal to a width of the cutting element; and a base portion having a width greater than the width of the elongated portion, the base portion being configured to secure the cutting tool to the movable cutting head.

14. A method of removing material, the method comprising:

moving a plurality of cutting tools about a rotation axis, each of the plurality of cutting tools includes a tool body and a cutting element, the tool body of each of the plurality of cutting tools having a front surface, a front slanted surface extending from the front surface, a back surface, a pocket formed in the tool body between the front slanted surface and the back surface, the pocket comprising a first surface and a second surface, the cutting element of each of the plurality cutting tools being secured to the tool body at least partially within the pocket and including a substrate having a back surface, a superhard table opposite to the back surface of the substrate and having a working surface offset from the front slanted surface and oriented at a back rake angle with respect to a longitudinal axis of the tool body and a side rake angle, wherein the first surface extends from the front slanted surface, is shaped complementary to a portion of the substrate, and is adjacent to only a portion of a side surface of the substrate, and the second surface extends from the back surface of the tool body and is adjacent to the back surface of the substrate;

advancing the plurality of cutting tools toward a target material; and engaging at least the working surfaces of the cutting tools with the target material, thereby failing at least some of the target material while having the working surfaces of the cutting tools oriented at the back rake angle and the side rake angle.

15. The method of claim 14, wherein at least two of the plurality of cutting tools are positioned at different positions.

16. The method of claim 14, wherein the back rake angle is a positive back rake angle.

17. The method of claim 14, wherein the back rake angle is a negative back rake angle.

18. The method of claim 14, wherein a first cutting tool of the plurality of cutting tools has a larger side rake angle than a second cutting tool of the plurality of cutting tools, and the first cutting tool is located closer to a rotation axis than the second cutting tool.

19. The method of claim 14, wherein the side rake angle of one or more cutting tools opens away from the rotation axis.

20. The method of claim 14, wherein the superhard table of a first cutting tool of the plurality of cutting tools has a larger chamfer than the superhard table of a second cutting tool of the plurality of cutting tools, and the first cutting tool is located closer to a rotation axis than the second cutting tool.

21. A material-removal system, comprising:

a cutting head rotatable about a rotation axis; and a plurality of cutting tools mounted on the cutting head, at least two of the plurality of cutting tools being positioned at different radial locations relative to the rotation axis of the cutting head, and each of the plurality of cutting tools including:

a tool body having a front surface, a front slanted surface extending from the front surface, a back surface, a pocket formed in the tool body between the front slanted surface and the back surface, the pocket comprising a first surface and a second surface; and a cutting element attached to the tool body to secure the cutting element at least partially within the pocket, the cutting element including a substrate and a polycrystalline diamond table having a substantially planar working surface offset from the front slanted surface and oriented at a back rake angle of 15 degrees to 20 degrees with respect to a longitudinal axis of the tool body and a side rake angle of 15 degrees to 20 degrees, the substrate including a back surface opposite to the superhard table;

wherein the first surface extends from the front slanted surface, is shaped complementary to a portion of the substrate, and is adjacent to only a portion of a side surface of the substrate, and the second surface extends from the back surface of the tool body and is adjacent to the back surface of the substrate.

22. The material-removal system of claim 21, wherein the back rake angle is a negative back rake angle or a positive back rake angle.

23. The material-removal system of claim 21, wherein side rake angle is a negative side rake angle or a positive side rake angle.

24. The material-removal system of claim 21, wherein at least one of the plurality of cutting tools has a different side rake angle than other cutting tools of the plurality of cutting tools.

25. The material-removal system of claim 21, wherein the cutting element of a first cutting tool of the plurality of cutting tools has a larger side rake angle than the cutting element of a second cutting tool of the plurality of cutting tools, and the first cutting tool is located closer to the rotation axis than the second cutting tool.

26. The material-removal system of claim 21, wherein the polycrystalline diamond table of a first cutting tool of the plurality of cutting tools has a larger chamfer than the polycrystalline diamond table of a second cutting tool of the plurality of cutting tools, and the first cutting tool is located closer to the rotation axis than the second cutting tool.

27. The material-removal system of claim 21, wherein at least some of the polycrystalline diamond tables of the plurality of cutting tools include a chamfer at least partially surrounding the substantially planar working surface.

* * * * *